US005450180A

United States Patent [19]

Ohzeki et al.

[11] Patent Number: 5,450,180

[45] Date of Patent: Sep. 12, 1995

[54] IMAGE FORMING APPARATUS HAVING CONSTANT CURRENT AND VOLTAGE CONTROL IN THE CHARGING AND TRANSFER REGIONS

[75] Inventors: Yukihiro Ohzeki, Kashiwa; Koichi Hiroshima; Junji Araya, both of Yokohama; Yasushi Sato, Kawasaki; Toshio Miyamoto, Tokyo; Kimio Nakahata, Kawasaki, all of Japan

[73] Assignee: Canon Kabushiki Kaisha, Tokyo, Japan

[21] Appl. No.: 240,212

[22] Filed: May 9, 1994

Related U.S. Application Data

[63] Continuation of Ser. No. 68,286, May 28, 1993, abandoned, which is a continuation of Ser. No. 845,361, Mar. 5, 1992, abandoned, which is a continuation of Ser. No. 428,932, Oct. 30, 1989, abandoned.

[30] Foreign Application Priority Data

Nov. 2, 1988 [JP] Japan ..... 63-276106
Nov. 2, 1988 [JP] Japan ..... 63-276107

[51] Int. Cl.[6] ..... G03G 15/16
[52] U.S. Cl. ..... 355/274; 355/277
[58] Field of Search ..... 355/208, 216, 217, 219, 355/221, 223, 271, 274, 275, 276, 277; 250/324, 325, 326

[56] References Cited

U.S. PATENT DOCUMENTS 3,781,105 12/1973 Meagher ..... 355/274
3,837,741 9/1974 Spencer ..... 355/274
4,563,081 1/1986 Sato ..... 355/208
4,949,125 8/1990 Yamamoto et al. ..... 355/219
4,977,430 12/1990 Florack et al. ..... 355/274
5,010,370 4/1991 Araya et al. ..... 355/274
5,034,777 7/1991 Ohzeki et al. ..... 355/274

FOREIGN PATENT DOCUMENTS 60-256173 12/1985 Japan .
61-14671 1/1986 Japan .
61-53668 3/1986 Japan .

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image forming apparatus includes a movable image bearing member; an image forming device for forming an image on the image bearing member; a charging member disposed opposed to the image bearing member; and bias application device for applying a bias voltage to the charging member, wherein the bias applying device effects a constant voltage control to the charging member when an image area of the image bearing member is in a charging region of the charging member, and effects a constant current control during at least a part of a period in which an area of the image bearing member other than the image area is in the charging region, and wherein a level of a constant voltage of the constant voltage control is determined during the constant current control.

93 Claims, 16 Drawing Sheets

IMAGE FORMING APPARATUS HAVING CONSTANT CURRENT AND VOLTAGE CONTROL IN THE CHARGING AND TRANSFER REGIONS

This application is a continuation of application Ser. No. 08/068,286 filed May 28, 1993, which is a continuation of Ser. No. 07/845,361 filed Mar. 5, 1992, which is a continuation of Ser. No. 07/428,932 filed Oct. 30, 1989, all now abandoned.

FIELD OF THE INVENTION AND RELATED ART

The present invention relates to an electrostatic copying machine or an electrostatic printer, more particularly to an image forming apparatus using a member such as a transfer roller or transfer belt, which is contacted to an image bearing member.

An image forming apparatus has been proposed which is provided with an image bearing member and a transfer member press-contacted thereto to form a nip therebetween through which a transfer material is passed, while the transfer member is supplied with a bias voltage, by which a toner image on the image bearing member is transferred onto the transfer material.

FIG. 9 shows an example of such an image forming apparatus.

A photosensitive member is in the form of a cylinder rotatable in the direction indicated by an arrow X about an axis perpendicular to the sheet of the drawing. The surface of the photosensitive member 1 is uniformly charged by a charging roller 3 energized with a power source 4, and is exposed to image information light through a slit exposure or by a laser beam modulated in accordance with the information, by which an electrostatic latent image is formed.

A developing device 9 supplies toner to the latent image to develop it into a toner image.

With the continued rotation of the photosensitive member 1, the toner image reaches a transfer station wherein a transfer roller 2 (the transfer member) is contacted to the photosensitive member 1 to form a nip. In timed relation with the toner image, a transfer material P comes to the transfer station. The transfer roller 2 is supplied with a transfer bias so as to apply electric charge having a polarity opposite to that of the toner to the backside of the transfer material, by which the toner image on the photosensitive member 1 is transferred onto the transfer material.

In the apparatus shown, the photosensitive member is made of OPC (organic photoconductor). The process speed is 23 mm/sec. The charging roller 3 is pressed-contacted to the photosensitive member 1 to rotate following the photosensitive member 1, and is supplied with a DC biased AC voltage to negatively charge it. The transfer roller 2 has a low volume resistivity to apply the positive electric charge to the backside of the transfer material.

The image exposure is in the form of a so-called image area exposure wherein the portion to receive the toner is exposed to light. The developing device 9 reverse-develops the image with negatively charged toner.

FIG. 10 shows the sequential steps of the operation of the above apparatus.

As compared with the case of using a corona discharger which is widely used, the contact type image transfer system is advantageous in that a high voltage source is not required, so that the cost is low; no electrode wire is used so that trouble resulting from the contamination thereof does not arise; ozone or nitride produced due to high voltage discharge is not produced; and the photosensitive member or the image quality is not deteriorated. However, it is known that the relation between the voltage applied to the transfer roller 2 and the current flowing therethrough (V-I characteristics) greatly changes with change in the ambient condition.

Under low temperature and low humidity conditions such as 15° C. and 10%, which will be hereinafter called "L/L condition", the resistance of the transfer roller is larger by several orders than under normal temperature and normal humidity conditions such as 23° C. and 60%, which will hereinafter be called "N/N condition". On the contrary, under high temperature and high humidity conditions such as 32° C. and 80%, which will hereinafter be called "H/H condition", the resistance is lower by 1–2 orders than under the N/N condition.

FIG. 11 shows the change of the V-I characteristics due to the ambient condition changes. In this Figure, the solid line shows the characteristics under the L/L, N/N and H/H conditions in the non-passage state wherein no transfer material exists at the transfer station such as during a prerotation period in which the image bearing member is rotated prior to an image forming operation, during a post-rotation in which the image bearing member is rotated after the image forming operation or during sheet intervals, that is, the intervals between the time when a transfer material passes through the transfer station and the time when the next sheet reaches the transfer station. The shown characteristics are when both of the AC component and the DC component are applied to the charging roller 3. The broken lines represent the V-I characteristics under the same conditions, but in the state in which a transfer material of A4 size is passing through the transfer station. Those characteristics are the V-I characteristics of the transfer roller 2.

Experimentally, it is confirmed that in order for good transfer operation to be carried out, the transfer current during the sheet passage is required to be 0.514 4 micro-ampere; and that if it is higher than 5 micro-ampere, transfer memory of positive potential remains in the OPC photosensitive member with the result of foggy background production.

Therefore, the proper transfer bias in this device is different depending on the ambient conditions; and is approximately 300–500 V under the H/H condition; is approximately 400–750 V under the N/N condition; and is approximately 1250–2000 V under the L/L condition.

If a constant voltage control is effected to the transfer roller 2 in this device, the following problems arise.

If the transfer roller is constant-voltage-controlled at 500 V with the view to the proper image transfer under the N/N condition, substantially the same image transfer properties are provided under the H/H condition. However, under the L/L condition, the transfer current is zero with the result of improper image transfer.

If the voltage is so selected that the transfer properties are improved under the L/L condition, the positive transfer memory is produced in the OPC photosensitive member during the non-passage state under the N/N and H/H conditions with the result of the foggy background being produced. Particularly during the H/H condition, the transfer current is increased also during the sheet passage period, so that the electric charge penetrates through the transfer material to charge the negatively charged toner on the photosensitive member surface to the opposite polarity with the result of improper image transfer.

If the constant current control is effected in an attempt to avoid the above problems, then the following problems arise. In the apparatus of this type, it is general that a transfer material having a size smaller than the maximum usable size can be used. When a small size transfer material is used, the photosensitive member and the transfer roller are directly contacted at a larger area than when a large size transfer material is used. If the above-described apparatus is constant-current-controlled at 1 microampere, the current per unit area through the portion which is directly contacted to the photosensitive member without the transfer material is equal to a current per unit area when a current of 1 micro-ampere flows through the non-passage period such as in the pre-rotation period, the post-rotation period or sheet intervals, and therefore, the voltage of the transfer roller decreases with the result that hardly any current flows through the portion where the transfer material exist, with the result of improper image transfer.

When a regular envelope (approximately 9 cm×21 cm) is used which is much smaller than an A4 size sheet, the transfer voltage decreases by a little more than 200 V under the H/H condition, by a little less than 200 V under the N/N condition and by approximately 400 V under the L/L condition, and therefore, the transfer current is substantially zero with the result of improper image transfer.

If the transfer current is increased with the view to sufficient image transfer property when the small size sheet is used, the current density through a relatively narrow non-passage portion as the difference between the widths of a letter size sheet and an A4 size sheet. This produces a foggy background due to the transfer memory on the photosensitive member surface, with the result of contamination on the back side of the next letter size sheet.

As will be understood from the foregoing, it has been difficult to provide good image transfer properties for wide variety of sizes of the sheets under wide conditions, by either of the constant voltage control or the constant current control in the above-described type of apparatus.

SUMMARY OF THE INVENTION

Accordingly, it is a principal object of the present invention to provide an image forming apparatus capable of stably forming good images under various ambient conditions.

It is another object of the present invention to provide an image forming apparatus capable of providing stabilized good transfer properties under various ambient conditions for various sizes of the transfer materials.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
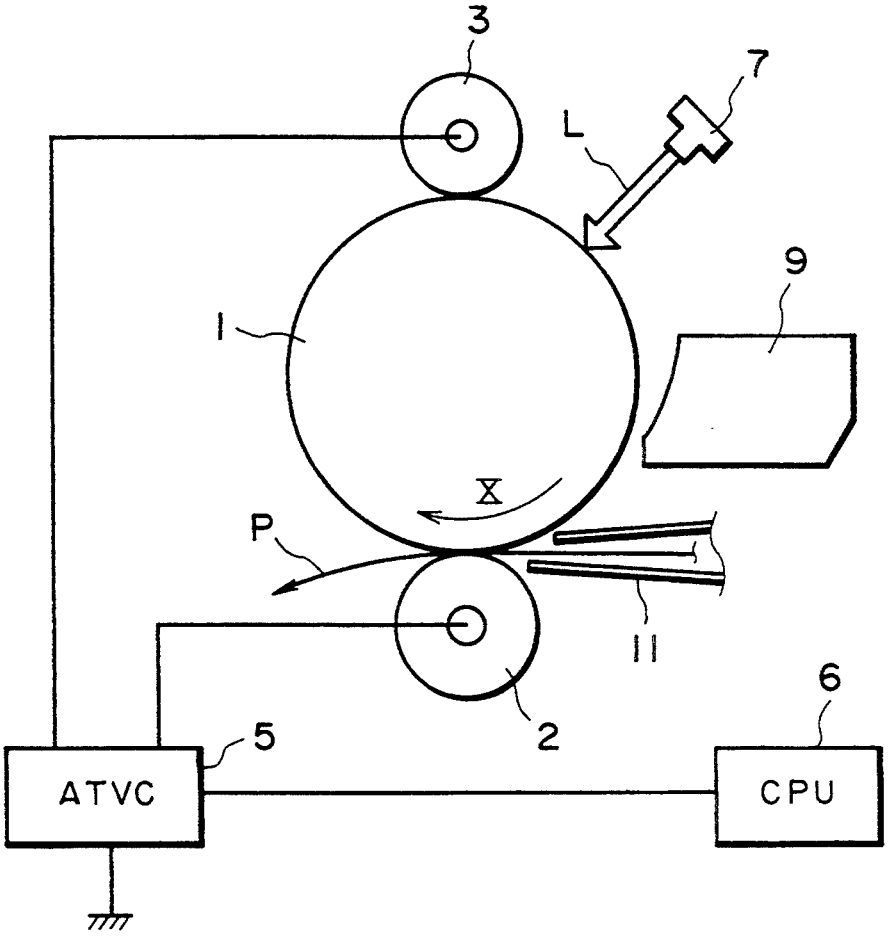
FIG. 1 is a sectional view of an image forming apparatus according to an embodiment of the present invention.

Referring to FIG. 1, there is shown an image forming apparatus according to an embodiment of the present invention, wherein a surface of an OPC (organic photoconductor) photosensitive member having a negative chargeable property and having a diameter of 30 mm, which is rotatable in a direction indicated by an arrow X at a process speed of 23 mm/sec, is uniformly negatively charged by a charging roller 3. Thereafter, the charged surface is exposed by a laser scanner 7 to a laser beam modulated in accordance with an electric signal representing information. The potential of the exposed portion is attenuated so that an electrostatic latent image is formed. With the continued rotation of the photosensitive member 1, the latent image comes to a position opposed to a developing device 9, and the latent image is supplied with negatively charged toner particles, by which a toner image is formed by deposition of the toner to the portion where the laser beam is projected and the potential is attenuated, through a reverse development.

Downstream of the developing device with respect to the movement direction of the photosensitive member 1, there is disposed a conductive transfer roller 2 press-contacted to the photosensitive member to form a nip which constitutes the image transfer position or zone.

When the toner image reaches the transfer position or zone, a transfer material P such as a sheet of paper is supplied to the transfer position in timed relation therewith, and the toner image on the surface of the photosensitive member is transferred onto the transfer material by a transfer bias voltage applied to the transfer roller 2. The transfer roller 2 functioning as a charging member for charging the transfer material electrically charges, in the transfer position, a side of the transfer material P which is opposite from the side contacted to the photosensitive member 1, to a positive polarity, by which the negatively charged toner is transferred from the surface of the photosensitive member to the transfer material P.

To the charging roller 3 and the transfer roller 2, predetermined voltages are applied by a voltage source capable of a constant voltage control and a constant current control (active transfer voltage control (ATVC)).

When a CPU 6 receives a print signal from an external apparatus such as a computer, the CPU 6 supplies a drive signal for a main motor to a motor drive circuit (not shown) for driving the photosensitive member 1, and simultaneously, it supplies a primary high voltage actuating signal to the voltage source 5 to apply the charging bias to the charging roller 3, by which the surface of the photosensitive member 1 is charged to $Vd=-700$ V which is a dark potential.

Then, the CPU 6 supplies a signal to the laser scanner 7 (image information writing means) to project a laser beam to the photosensitive member to form an electrostatic latent image thereon.

Thereafter, the CPU 6 transmits an image transfer performing signal to the voltage source 5, upon which the voltage source 5 performs a constant voltage and constant current control which will be described hereinafter in detail.

When the voltage source 5 receives the transfer performing signal when a non-image portion of the photosensitive member is present at the transfer position, the constant current control is effected to the transfer roller. In the apparatus shown, a constant current of 5 micro-ampere flows through the transfer roller.

Then, the voltage source 5 holds or stores the voltage produced on the transfer roller 2 and stops the constant current control. When the image area of the photosensitive member where the toner image is formed is brought into the transfer position, the constant voltage control (ATVC) is effected to the transfer roller using the voltage stored. Thus, the voltage level at which the constant voltage control is effected is determined when the constant current control is performed before.

Figure 3:
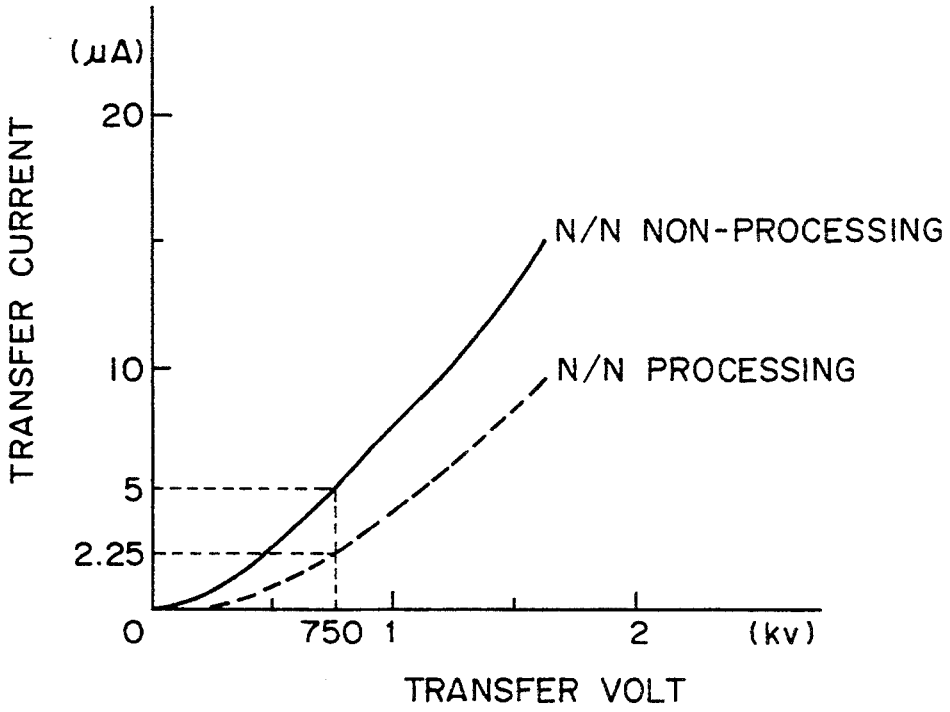
FIG. 3 is a graph showing V-I characteristics of the transfer roller under normal temperature and normal humidity condition (N/N).

Referring to FIG. 3, V/I characteristics of the transfer roller of the transfer roller 2 having an electric resistance varying with ambient conditions are shown under the N/N condition. As will be understood from this Figure, the voltage required for applying an image transfer current of 5 micro-amperes through the transfer roller is approximately 750 V when no transfer material is present in the transfer position and when the potential of the photosensitive member is Vd. When the voltage of this 750 V is applied to the transfer roller, the transfer current is approximately 2.25 micro-amperes when a transfer material is present at the transfer position.

By controlling the voltage and current of the transfer roller in the manner described above, the transfer roller is constant-voltage-controlled at 750 V under the N/N condition, at which time the current of 2.25 micro-amperes flows through the transfer roller, by which good image transfer is performed.

Figure 2:
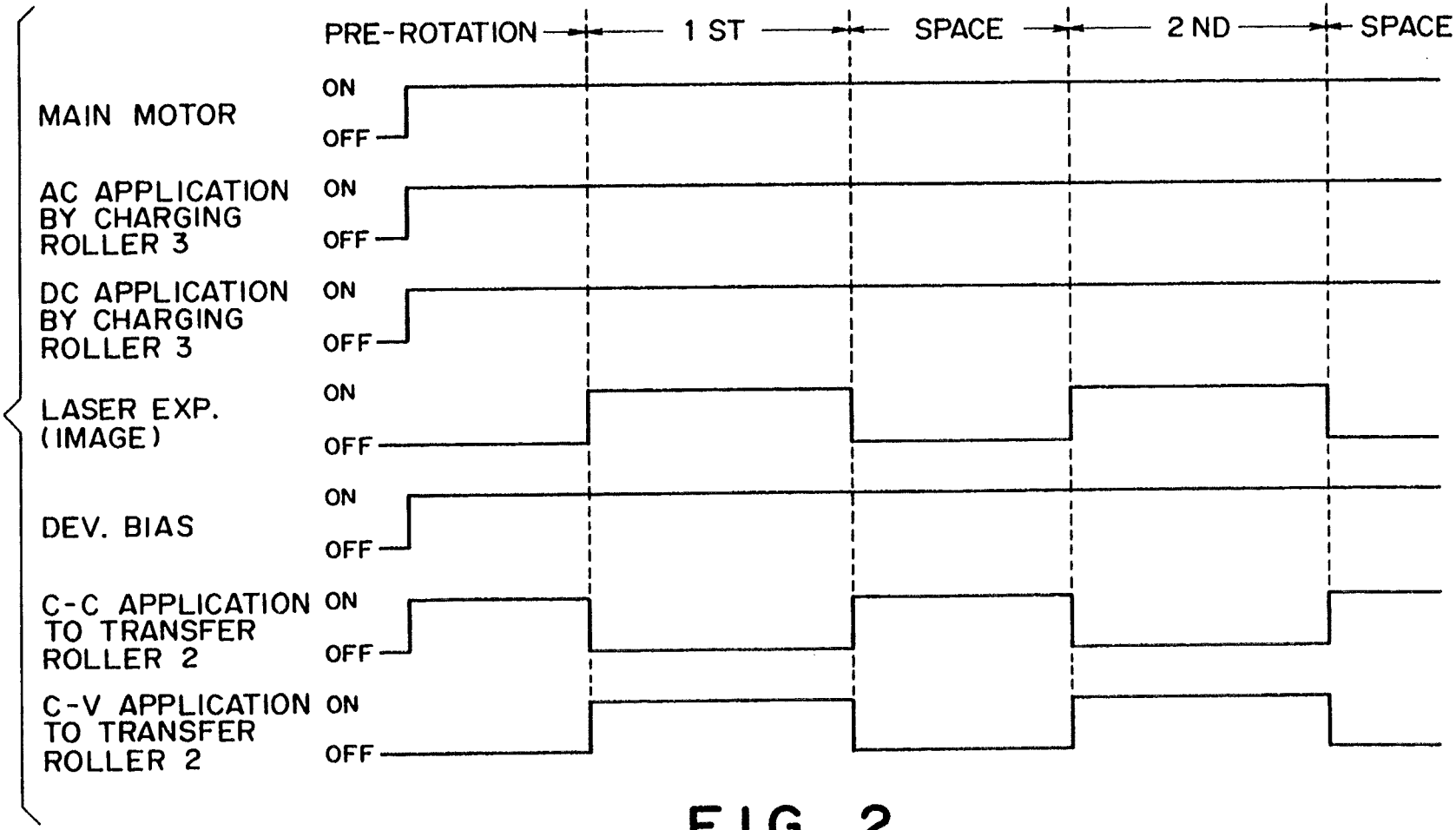
FIG. 2 is a timing chart illustrating operational timing in operation of FIG. 1 apparatus.

During a continuous image forming operation in which a predetermined number of image forming operations are performed continuously, as will be understood from a timing chart of FIG. 2, the constant current control is performed to the transfer roller during the sheet interval which is the interval from a time at which a transfer sheet passes through the transfer position to a time at which a next transfer sheet reaches the transfer position, that is, the time interval during which the non-image portion between adjacent transfer materials on the image bearing member is passing through the transfer position. During the sheet passage through the transfer position, the constant voltage control is effected to the transfer roller. Thus, the constant current control is effected while the non-image portion upstream and downstream of the image portion is passing through the transfer station.

The transfer roller 2 is made of EPDM having an Asker C hardness of 25 degrees in which carbon is dispersed to provide electric conductivity so as to provide a volume resistivity of approximately $10^5$–$10^6$ ohm.cm.

Figure 4:
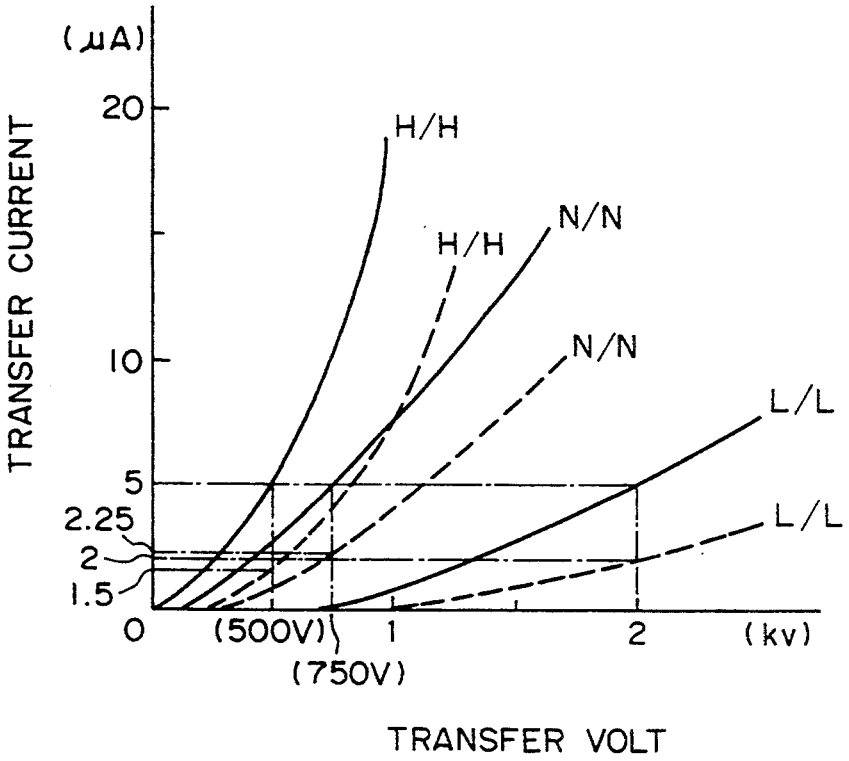
FIG. 4 is a graph showing the V-I characteristics of the transfer roller under low temperature and low humidity condition (L/L), under normal temperature and normal humidity condition and under high temperature and high humidity condition (H/H).

However, the EPDM material is largely influenced by ambient conditions. When a roller having an aluminum cylinder coated with the EPDM layer having a length of 220 mm was press-contacted to a photosensitive member 1 so as to form a nip having a width of 4 mm, and the resistance was measured, the results were $10^5$–$10^6$ ohm.cm under the L/L condition, $10^4$–$10^5$ ohm.cm under the N/N condition and $10^3$–$10^4$ ohm.cm under the H/H condition. Referring to FIG. 4, the functions under various conditions will be described when the control system described above is incorporated in the above apparatus.

Under the H/H condition, the voltage source 5 constant-current-controls the transfer roller 2 at 5 micro-amperes during the transfer material non-passage period. By this, a voltage of 500 V is produced across the transfer roller, corresponding to the resistance of the transfer roller under the H/H condition. This voltage is stored, and the transfer roller 2 is constant-voltage-controlled at 500 V during the transfer material passage period. Thus, the voltage applied to the transfer roller during the constant voltage control is determined on the basis of the voltage produced across the transfer roller during the constant-current control.

By such a control, a transfer current of 1.5 micro-ampere is provided when an A4 size transfer sheet is passed through the transfer position, and is sufficient to carry out the good image transfer action.

Even if a transfer material which is smaller than the A4 size is passed, the voltage of 500 V is maintained at the transfer roller 2 in the portion where the transfer material exists. Therefore, the transfer current of 1.5 micro-ampere can be provided, so that the good image transfer operation is performed.

During the non-passage period, only 5 micro-amperes flows, so that the transfer memory which will result in production of foggy background or which will result in toner deposition on the portion of the previous image portion, is not produced on the surface of the photosensitive member.

In the transfer material non-passage area between a large size sheet and a small size sheet, the constant voltage control is effected during the passage period, and therefore, the current density does not exceed the level of approximately 5 micro-amperes, so that the transfer memory does not remain in the photosensitive member.

The following applies to the N/N and L/L conditions.

Under the N/N condition, similar to that described above, the transfer roller 2 is subjected to the constant current control of 5 micro-amperes during the non-passage period.

At this time, a voltage of 750 V corresponding to the resistance of the transfer roller 2 under the N/N condition is applied to the transfer roller 2. The voltage is stored, and the constant voltage control of 750 V is effected during the subsequent transfer material passage period.

By doing so, the transfer current is 2.25 micro-ampere when an A4 size sheet is passed, and is sufficient to provide the good image transfer action.

Under the L/L condition, when the sheet is not passed through the transfer position, the constant current control is carried out, by which the voltage of the transfer roller 2 is 2 KV which corresponds to the resistance of the transfer roller 2 under the L/L condition. Therefore, during the transfer material passage period, the constant voltage control of 2 KV is effected to the transfer roller 2. At this time, the transfer current through the transfer roller 2 is 2 micro-amperes, with which good image transfer properties can be obtained.

As described in the foregoing, the constant current control is carried out during the transfer material non-passage period, whereas the constant voltage control is carried out during the transfer material passage period, by which good image transfer properties can be provided at all times irrespective of the size of the transfer material, so that the foggy background attributable to the transfer memory is not produced, and that the good image quality can be provided.

Figure 5:
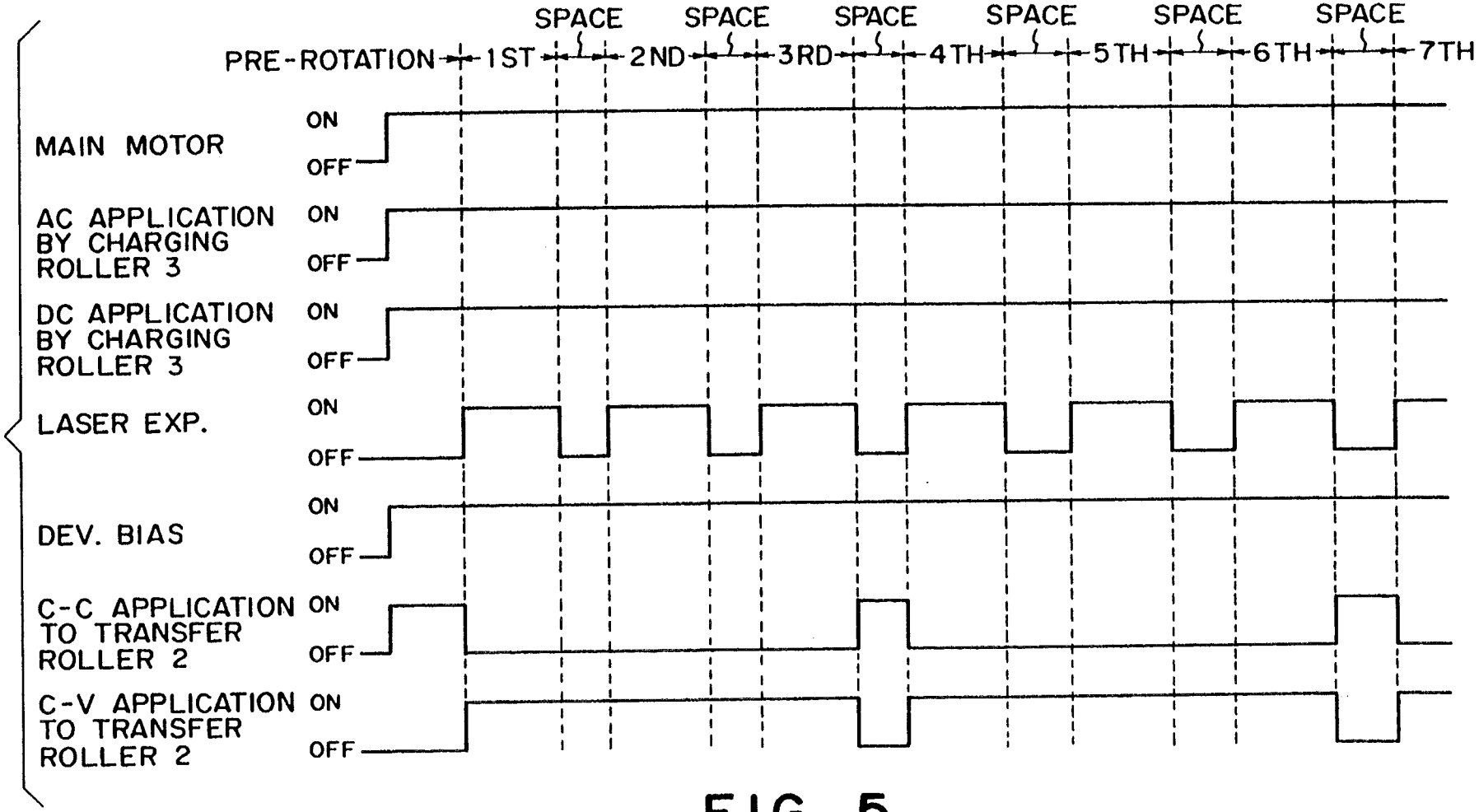
FIGS. 5–7 are timing charts illustrating other examples applicable to the image forming apparatus of the present invention.

FIG. 5 shows another example of the ATVC control in the image forming apparatus according to the present invention.

In this example, when the image forming apparatus is operated in a single mode wherein the image formation process is performed one by one, the ATVC control is performed for each image formation, whereas when the image forming apparatus is operated in a continuous mode in which plural images are continuously formed, the ATVC control is carried out for every three image formations, as shown in FIG. 5. More particularly, the constant current control is carried out to the transfer roller during the prerotation period in which the charging operation or the image exposure operation is not performed to the photosensitive member for the purpose of image formation, and thereafter, the same constant voltage control is effected to the transfer roller until a predetermined number of image forming regions passes through the transfer position. The constant current control may be performed during at least a part of the period in which such an area of the photosensitive member as is outside the image area is passing through the transfer position. The same results were obtained under various conditions with this structure, namely, the good quality of the image was provided. In this example, the ATVC control was performed for every three image formations (transfer materials), but the number is not limited to three.

Figure 6:
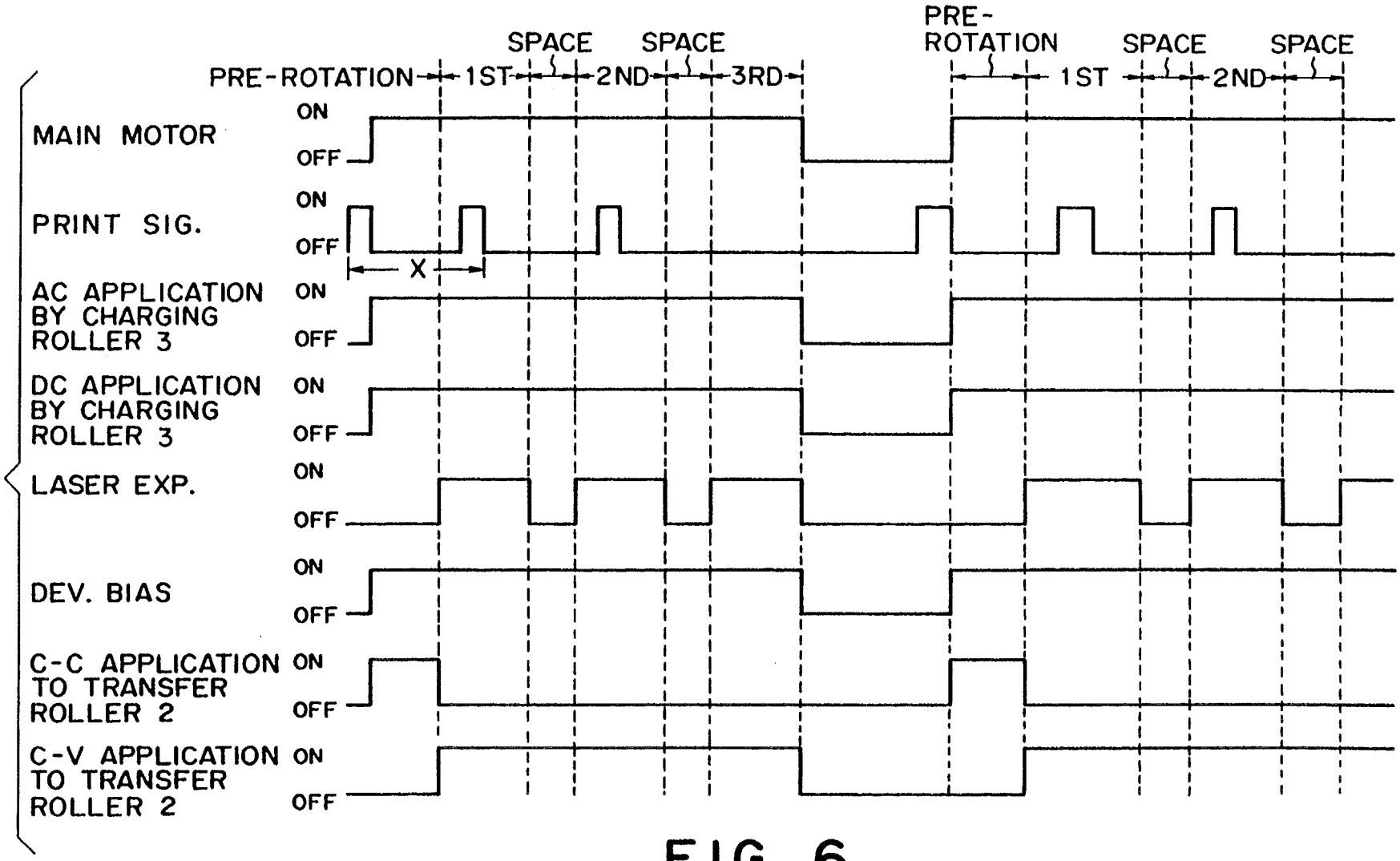

FIG. 6 shows an example of the ATVC control applied to a printer such as a laser beam printer, LED printer or LCS printer or digital copying machines using them.

In this example, when the CPU (central processing unit) 6 receives a printing signal within a predetermined period (x in FIG. 6) from the previous reception of the printing signal by the CPU 6, the voltage stored by the ATVC control during the printing operation in response to the previous printing signal is maintained, and the printing operation is performed with this stored voltage maintained. Thus, when a printing signal has already been inputted, the ATVC control is not performed in response to the next printing signal, and the constant voltage control on the basis of the previous printing signal is continued.

However, if the printing signal is not supplied to the CPU within the period x, the ATVC control is performed when the next printing signal is supplied.

In this manner, the same results as in the described foregoing can be provided. This example of the control system is particularly advantageous when the V-I characteristics of the transfer roller do not change during the one job, that is, when the ambient condition does not change, in that the ATVC control may only be performed during the pre-rotation period, so that the image forming operation can be started quickly after the input of the next printing signal.

Figure 7:
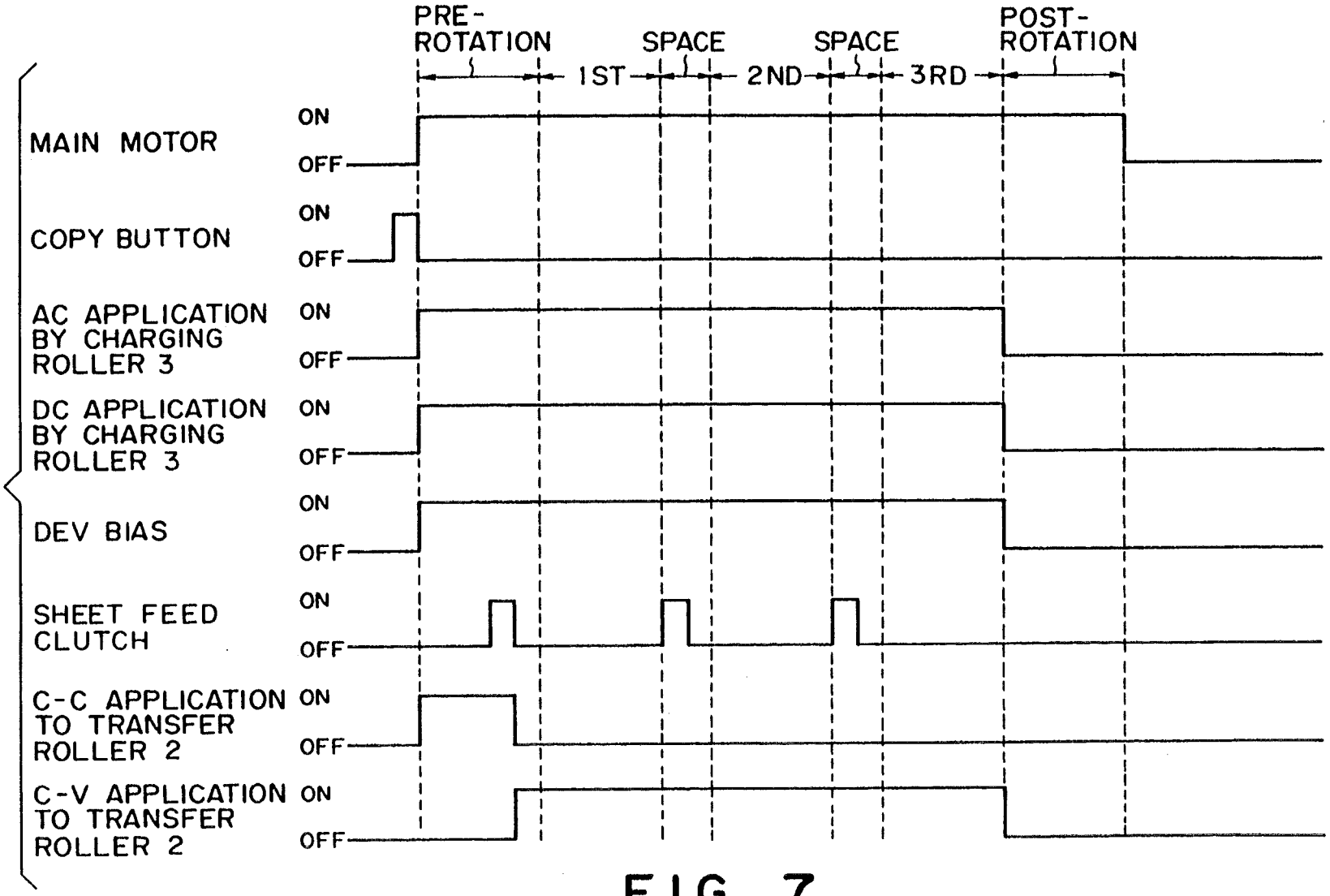

FIG. 7 shows another example wherein the ATVC control according to the present invention is applied in a copying machine. In this example, the ATVC control is performed during the pre-rotation period after the copy button is depressed, and thereafter, during the copy operation, the constant voltage control is performed. FIG. 7 shows the control operations when three copies are produced.

Figure 8:
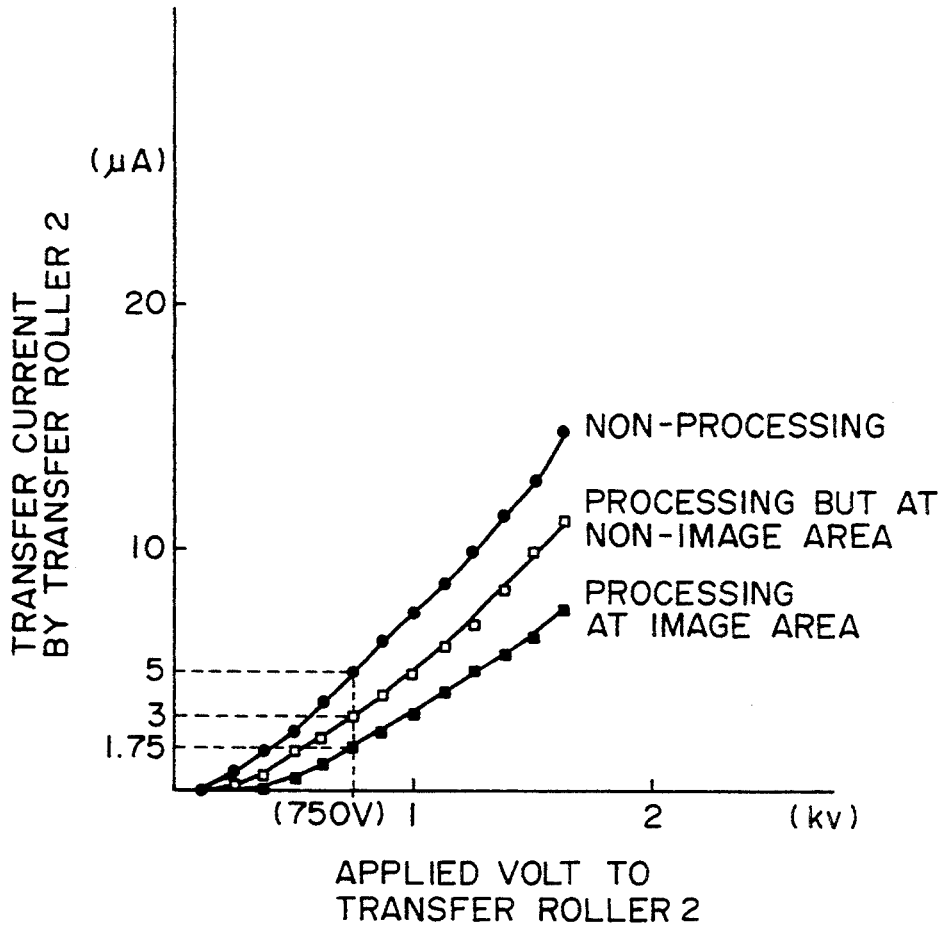
FIG. 8 is a graph showing V-I characteristics at an image area and a non-image area under a certain ambient condition.
Figure 9:
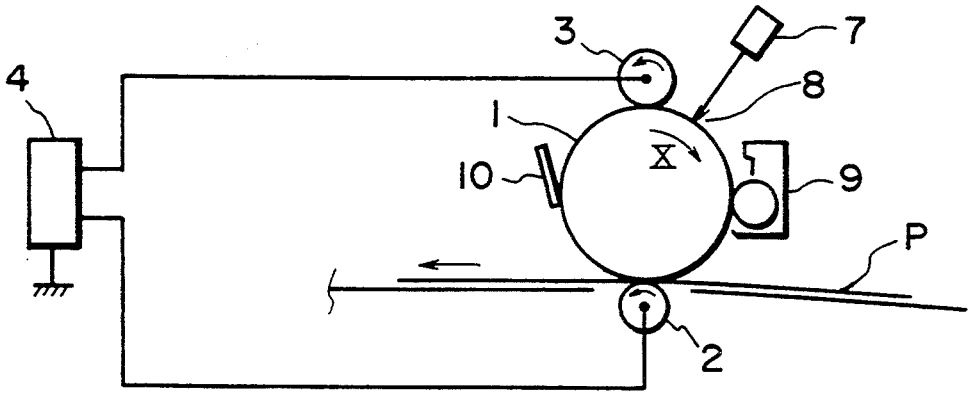
FIG. 9 is a sectional view of a conventional image forming apparatus.
Figure 10:
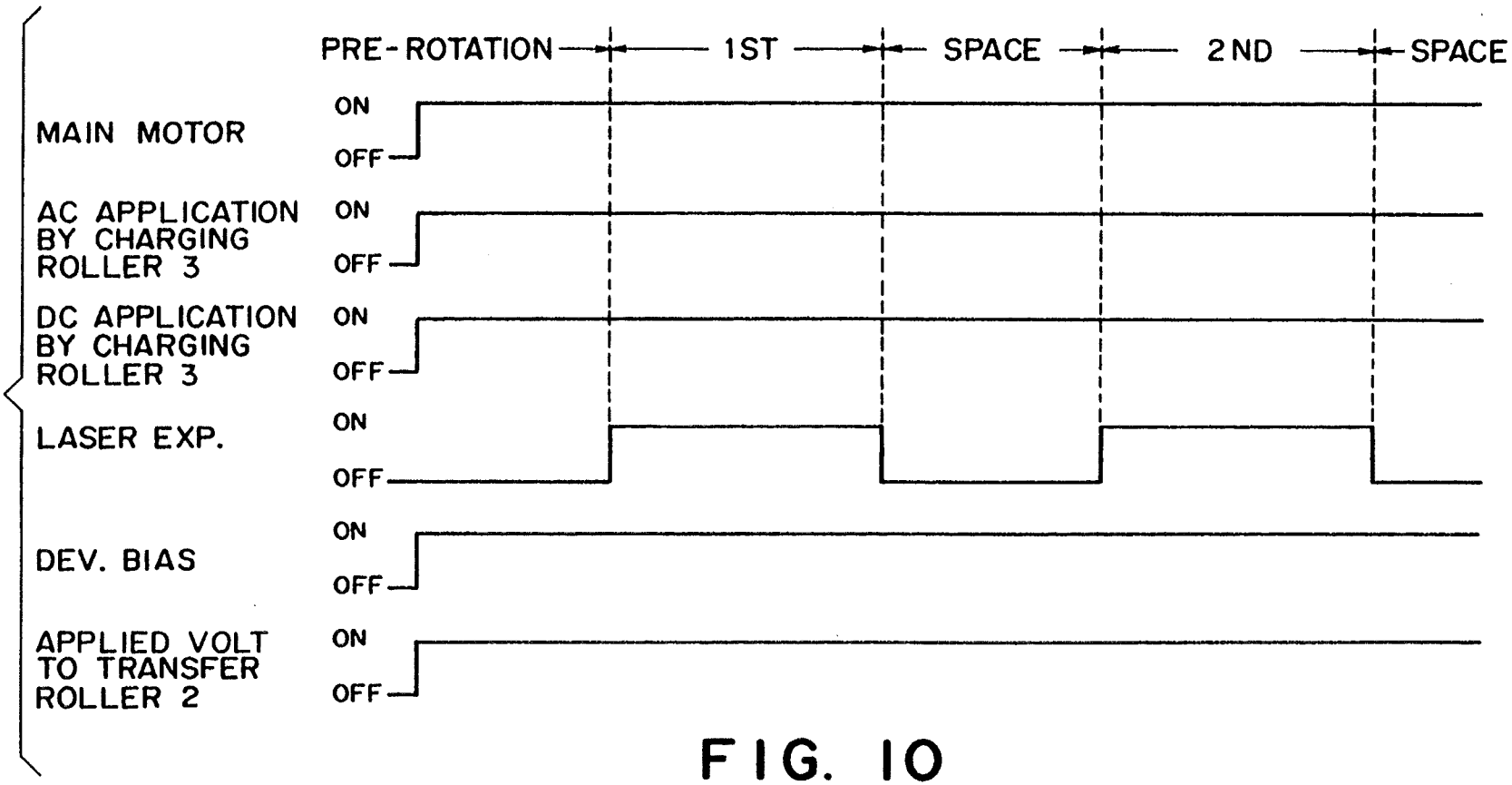
FIG. 10 is a timing chart illustrating the operation of the FIG. 9 apparatus.
Figure 11:
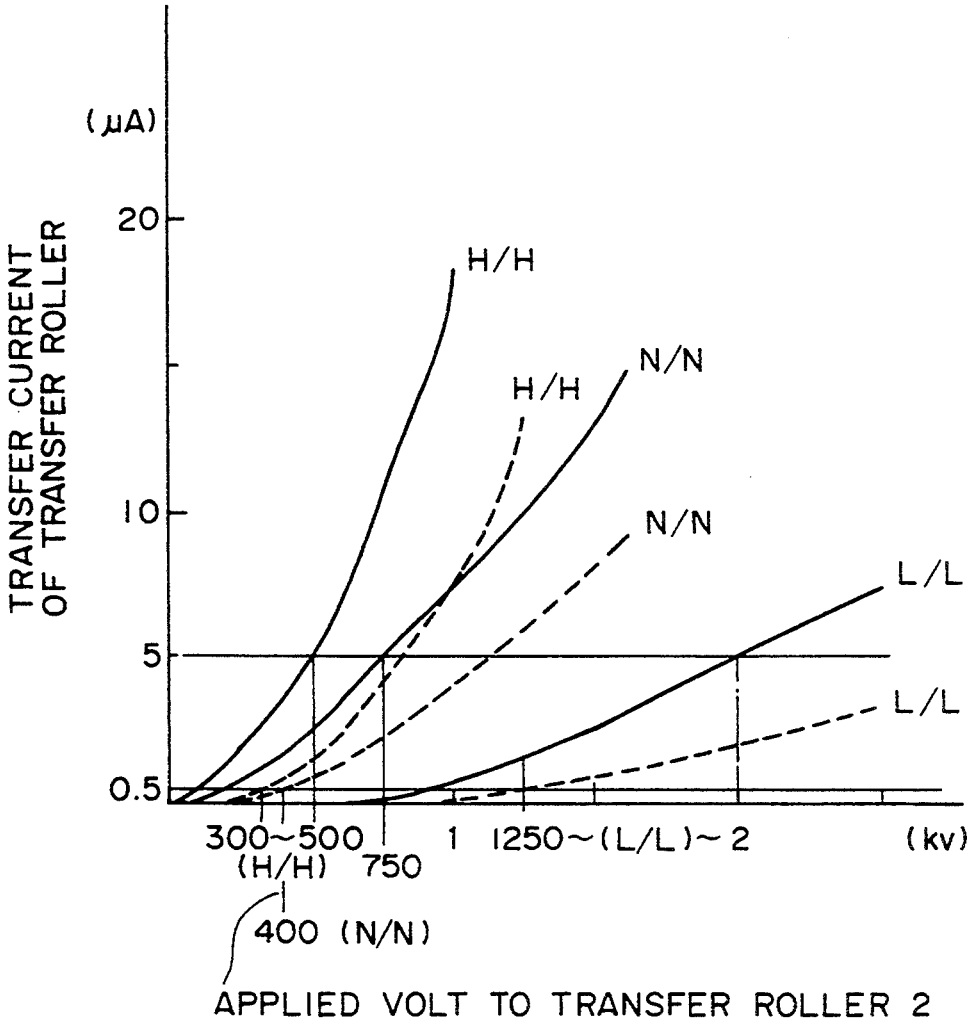
FIG. 11 is a graph showing V-I characteristics under a low temperature and low humidity condition, under a normal temperature and normal humidity condition and under a high temperature and high humidity condition.

FIG. 8 shows an example wherein the ATVC control according to this invention is operated differently. The period in which the transfer material is present in the transfer position is divided into a non-image area where the photosensitive member does not have the image and the area where it has the image. During the former period, the constant current control is effected to the transfer roller 2, and the voltage during that period is stored, and then, during the image period, the constant voltage control of the stored voltage is effected to the transfer roller 2.

Referring to the same Figure, the V-I characteristics of the transfer roller 2 under a certain condition is shown in the image forming apparatus having the above structure, wherein the solid black circle represents the transfer material non-passage period; the square represents the non-image area period in the transfer material passage period; and solid black square represents the image area period in the transfer material passage period.

As will be understood from this graph, even within the transfer material passage period, the characteristics are different between the image area and the non-image area due to the difference in the surface potential of the photosensitive member.

Therefore, by performing the constant current control in the non-image area period during the transfer material passage period, the similar functions can be provided as in the control to the transfer material passage period and the transfer material non-passage period on the basis of the presence or absence of the transfer material in the transfer position.

In the case of FIG. 8, the constant current control is effected to the transfer roller 2 with 3 micro-amperes in the non-image area passing period in the transfer material passage period, and the same result as in the control in which 5 micro-ampere control is effected during the non-passage period. Therefore, the current of the constant current control is lower than in the foregoing embodiment.

In the image forming apparatus using the laser beam, a light intensity correction operation (APC) is effected to a region of the photosensitive member which corresponds to the non-passage period between the adjacent transfer materials. If the above-described ATVC is carried out without regard to the APC operation, the following problems arise.

Figure 17A:
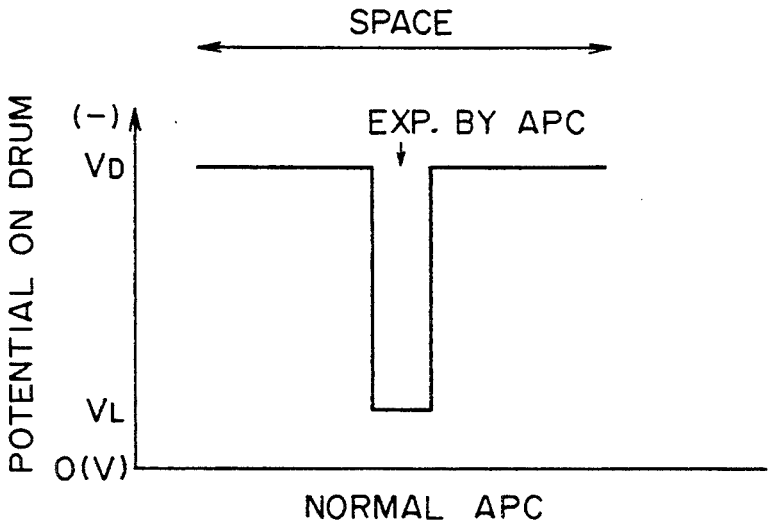
FIGS. 17A, 17B and 17C show a surface potential level change of an image bearing member under the control between intervals of adjacent transfer sheets.
Figure 17B:
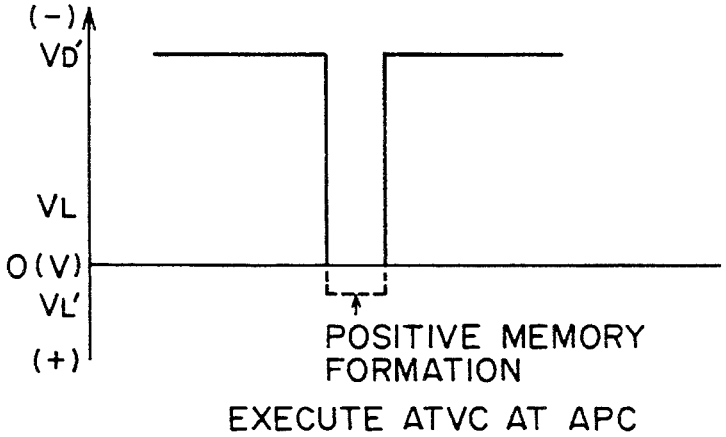
Figure 17C:
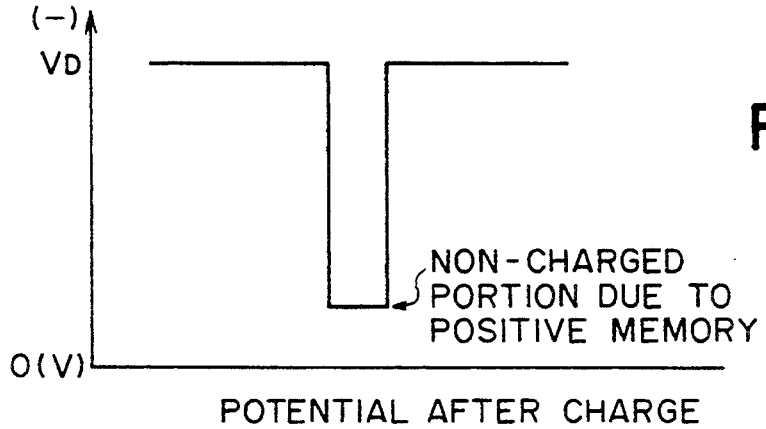

FIGS. 17A, 17B and 17C explain the problems. If the APC operation and the ATVC control are simultaneously executed to a certain region of the photosensitive member, and if a constant positive current is applied to the transfer roller, the current flows through the light portion which is exposed to light by the APC operation. Particularly if the level of the constant current is high, the positive memory is produced in the photosensitive member irrespective of the dark potential portion (Vd) which has been electrically charged but has not been exposed to light by the APC and the light potential portion (Vl) which is exposed to light by the APC operation.

If the positive current is small during the constant current control operation, the memory is not produced in the negatively charged Vd portion as shown in FIG. 17B, but the memory is produced in the Vl area.

When the current level is further smaller, the memory is not produced. However, the current sufficient to the ATVC control can not be obtained during the constant current control with the result of insufficient image transfer.

The potential of the portion in which the positive memory is produced, is slightly increased by the primary charge during the next image forming operation, and the memory portion on the photosensitive member surface is developed with negative toner in the developing station, as shown in FIG. 17C, and it appears as a foggy background in the next transfer material, thus deteriorating the image quality. It results in the improper image transfer, as the case may be, as described in the foregoing. Practically, there is no latitude of the level of the constant current for the ATVC operation to prevent both of the inconveniences.

Figure 12:
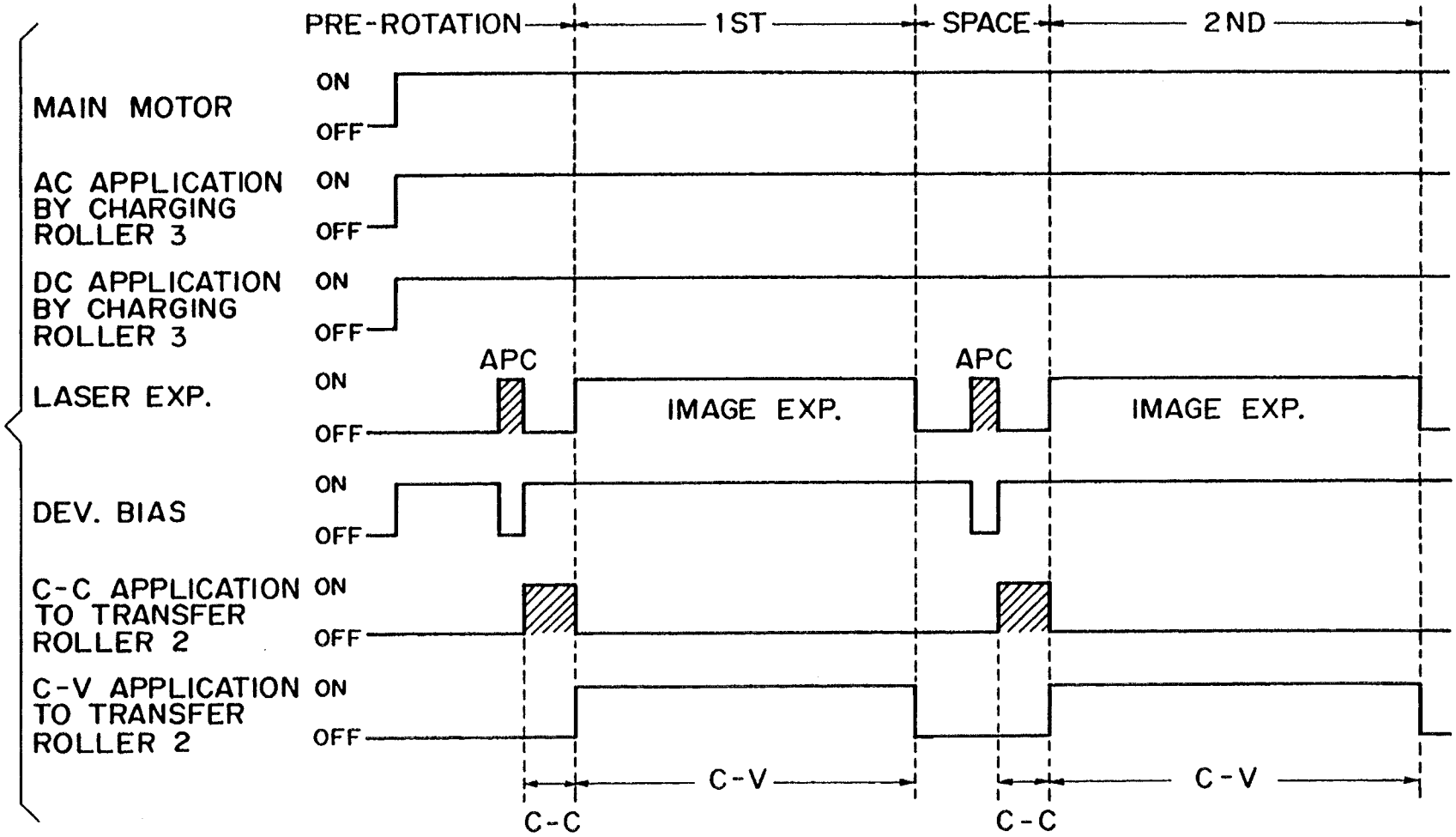
FIGS. 12–14 are timing charts illustrating other examples of an operation of the image forming apparatus of the present invention.

In consideration of the above, the constant current control in the ATVC operation is executed immediately after that area of the photosensitive member which has the potential Vl due to the APC operation passes through the transfer position, as shown in FIG. 12. The constant current control is performed during at least a part of the period in which the area of the photosensitive member other than the image area is passing through the transfer position.

When the portion having the potential Vl provided by the APC operation is contacted to the transfer roller 2, the constant current application to the transfer roller 2 is stopped, and the transfer roller is grounded. Therefore, the current does not flow through the Vl portion, and therefore, the positive memory is not produced in the photosensitive member.

When the image forming operations were performed actually with the APC operation and the ATVC operation at the timing shown in FIG. 12, it was confirmed that no positive memory was produced in the Vl portion, and therefore, it did not appear as a trace of the APC operation on the next transfer material.

Figure 13:
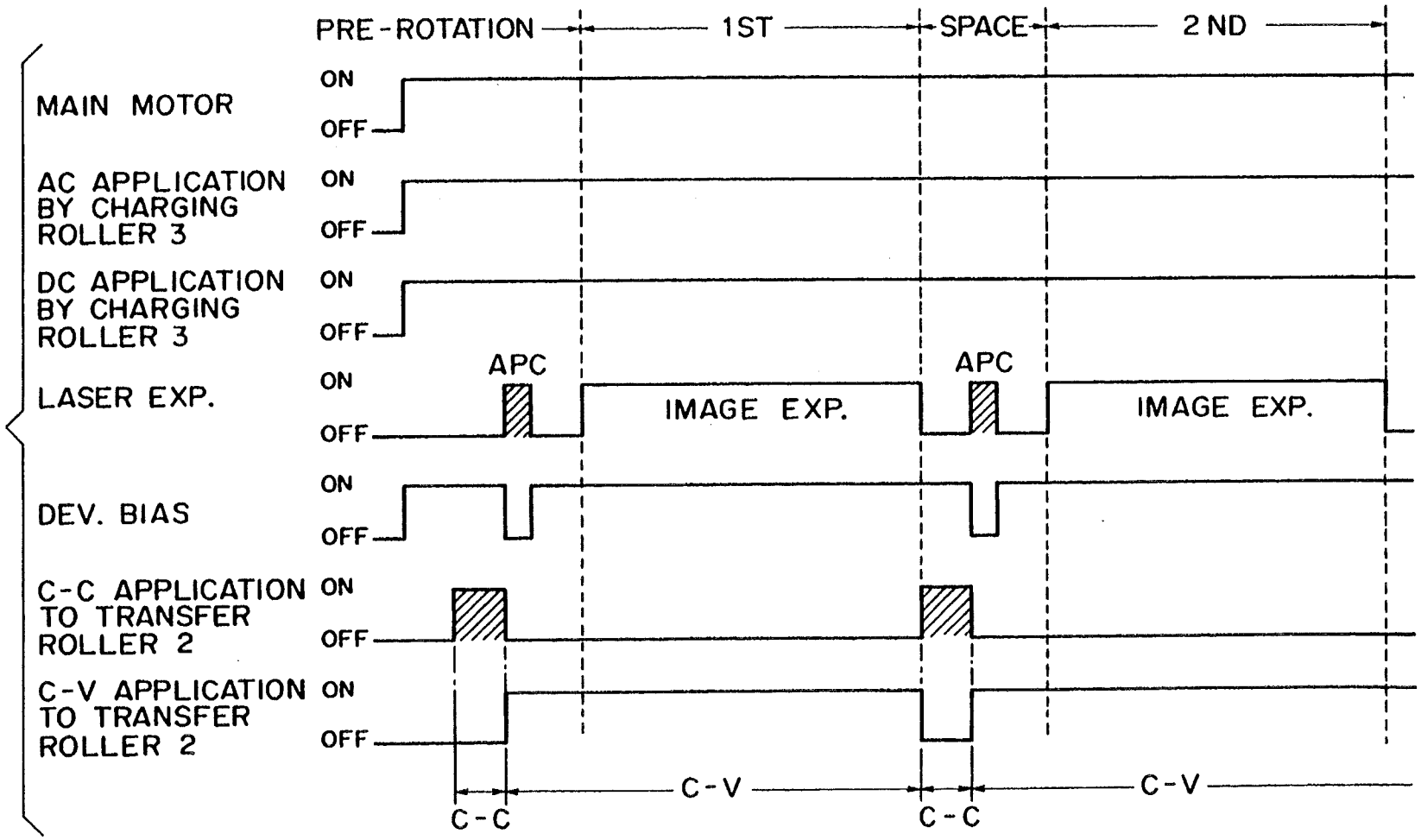

FIG. 13 shows another example of the control according to the present invention. In this example, the constant current control of the ATVC operation is performed at the time before the execution of the APC operation and during the pre-rotation and during the transfer material non-passage period between the adjacent transfer materials.

In the APC region following it, the voltage stored by the ATVC operation is applied and is maintained until the completion of the transfer operation. Immediately after the completion of the image transfer, the constant current by the ATVC operation flows into the Vd potential portion of the photosensitive member until immediately before the next APC operation.

Figure 14:
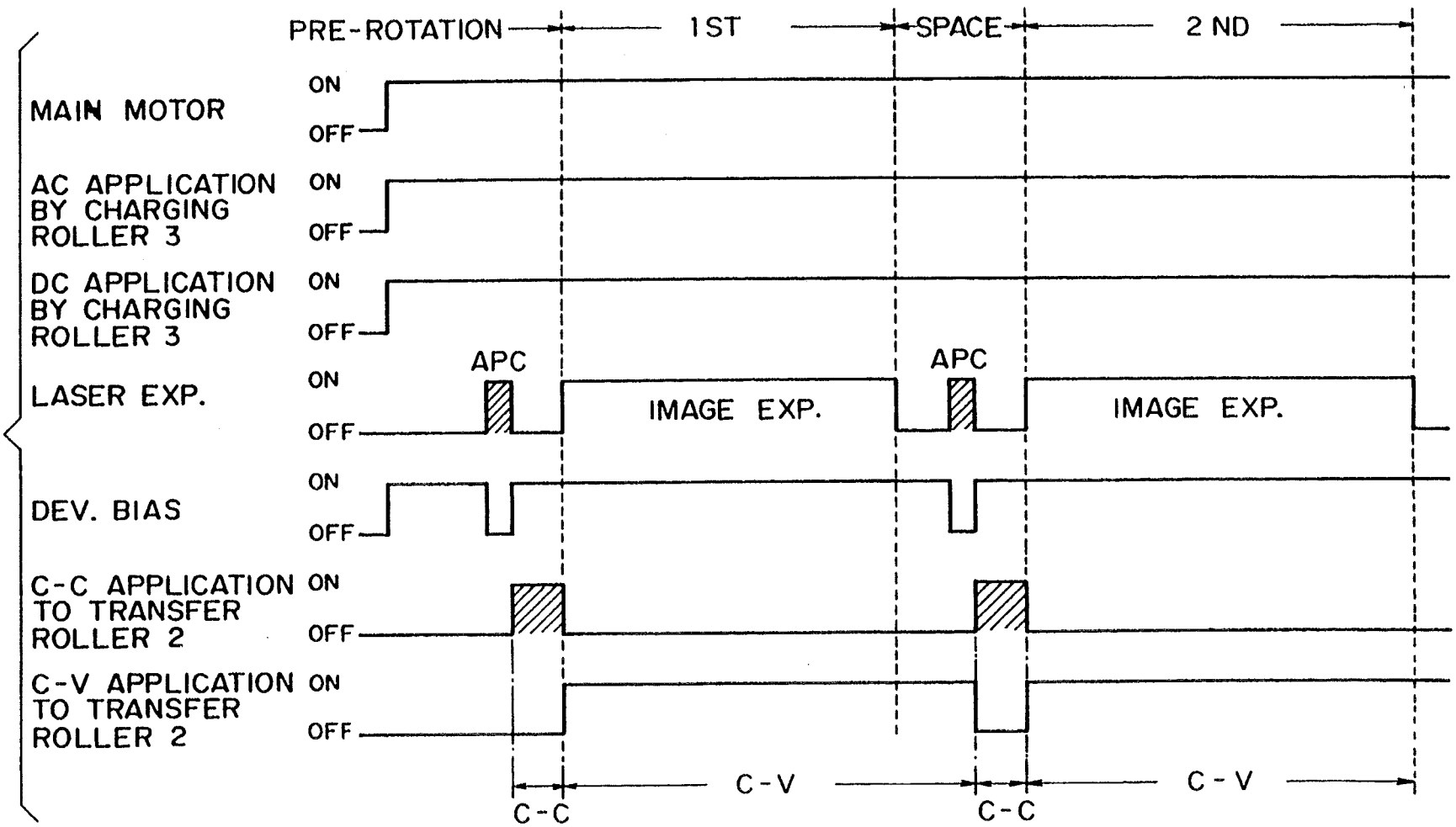

FIG. 14 shows another example of the control. As compared with the case of FIG. 12, this example is different in that after the trailing edge of the previous image area and immediately before the constant current control area of the next ATVC operation, including the APC operation region, the constant current control is performed with the voltage stored during the previous image forming operation.

In the operation shown in FIG. 12, the transfer roller is grounded from the passage of the trailing edge of the previous image in the transfer material non-passage period between the adjacent transfer materials to the completion of the APC region. Therefore, the voltage source for the image transfer operation can selectively provide the constant current, the constant voltage and the ground voltage.

However, the control shown in FIG. 14 eliminates the necessity of the ground level control for the transfer roller and therefore, the control circuit is simplified correspondingly.

With this control system, the constant voltage is applied to the Vl potential portion of the photosensitive member provided by the APC, but no memory is produced.

Figure 16:
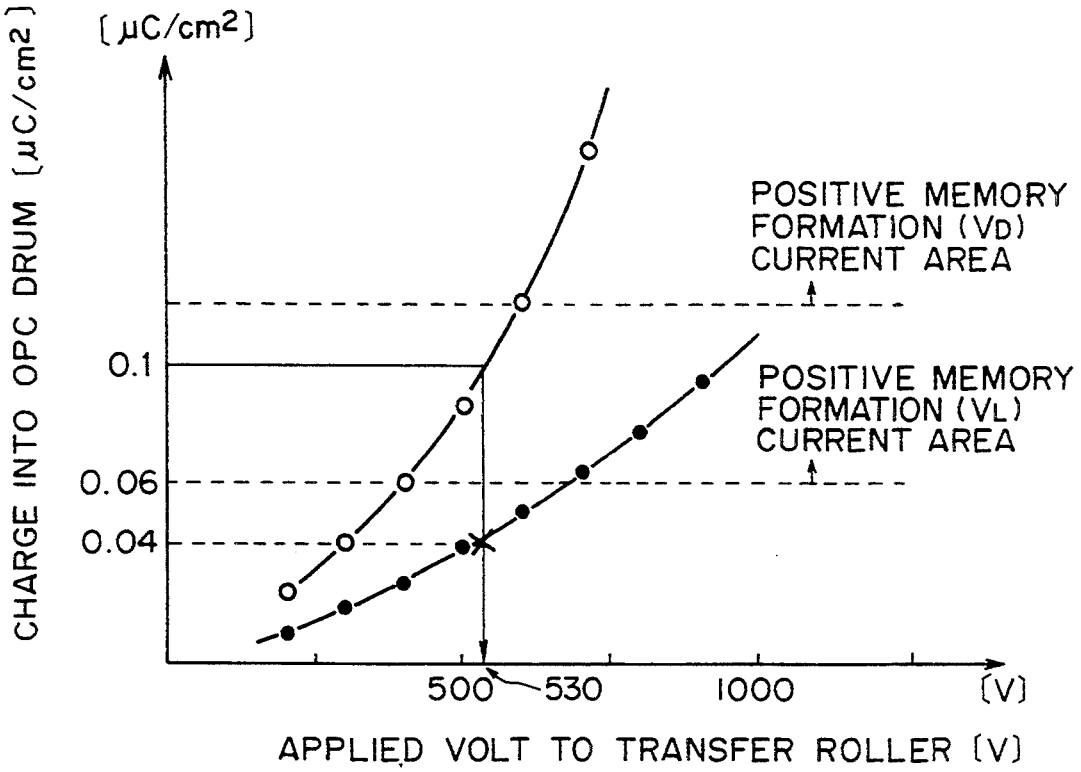
FIG. 16 is a graph showing V-I characteristics under a normal temperature and normal humidity condition of a roller/electrode relative to a photosensitive member.

FIG. 16 shows an example of a voltage level provided during the constant current control when the ATVC operation is executed.

In the Figure, if the current when the ATVC operation is effected is 0.1 micro-coulomb/$cm^2$, the voltage level of 530 V results. The current flow by the voltage applied to the Vl portion is 0.04 micro-coulomb/$cm^2$. The current is sufficiently lower than 0.06 micro-coulomb/$cm^2$ which is the current limitation against the memory production. Therefore, even if the APC operation and the ATVC operations are simultaneously performed in the manner shown in FIG. 14, the same effect as in the foregoing embodiments can be provided.

Figure 15:
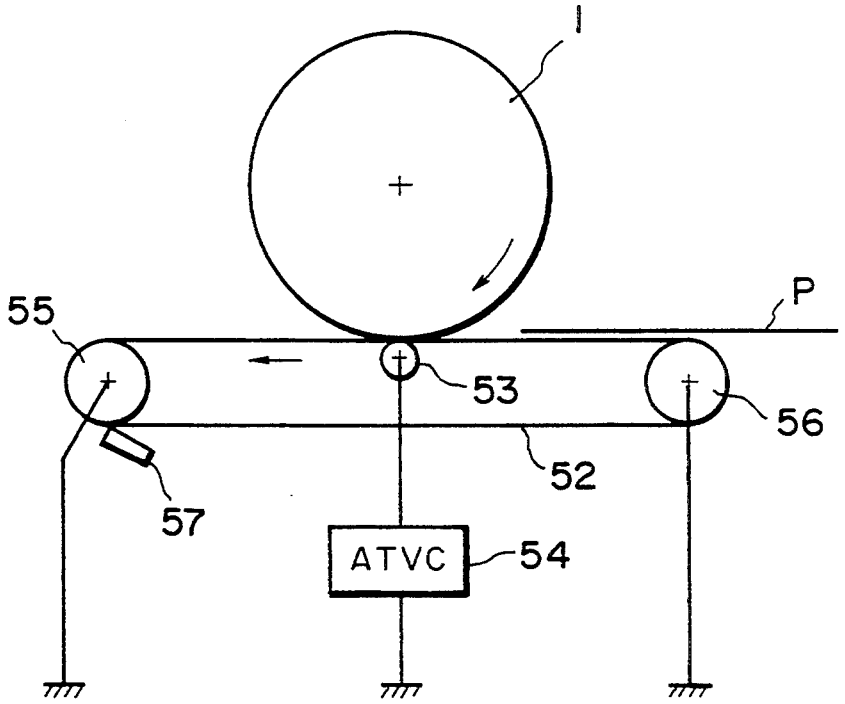
FIG. 15 is a sectional view of an image forming apparatus according to a further embodiment of the present invention.

FIG. 15 shows another embodiment of the image forming apparatus wherein the transfer means is in the form of a transfer belt.

The photosensitive member 1 is contacted to an image transfer belt 52 which is stretched between a driving roller 56 driven by an unshown driving means and a supporting roller 55 for rotation in the direction indicated by an arrow. The transfer material P is passed through an image transfer station which is formed by the contact between the photosensitive member 1 and the transfer belt 52, in a timed relation with the toner image on the surface of the photosensitive member.

Onto the transfer material P, the toner image is transferred from the photosensitive member 1 in the transfer position, by the voltage supplied from the voltage source 54 performing the ATVC operation to a roller electrode 53 disposed to the side opposite from the photosensitive member 1.

The transfer belt is cleaned by a cleaning blade 57 after the image transfer operation.

The transfer belt 52 is constituted by a single layer semiconductor made of polyvinylidene fluoride, polyester elastomer of thermoplastic property, polyolefin elastomer of thermoplastic property, polyurethane elastomer of thermoplastic property, polyethylene elastomer of thermoplastic property, polyamide elastomer of thermoplastic property, fluorinated elastomer of thermoplastic property, ethylene-vinyl acetate elastomer of thermoplastic property or polyvinyl chloride elastomer of thermoplastic property. The volume resistivity thereof is adjusted to be between $10^{11}$–$10^{15}$ ohm.cm by changing the polymer structure.

In this example, the transfer belt is made of polyvinylidene fluoride, and the volume resistivity is $10^{14}$ ohm.cm, and the thickness is 100 microns.

The roller electrode 53 is made of EPDM, and the volume resistivity is $10^5$–$10^6$ ohm.cm, and the Asker C hardness is 25 degrees.

Using such an apparatus, the ATVC control is executed at the timing shown in FIG. 12, 13 or 14. The current during the constant current control is dependent on the material of the belt and the volume resistivity thereof. In this example, it is approximately 0.15 micro-ampere/$cm^2$ when the length of the transfer roller 53 is 220 mm, and the nip width is 3 mm.

When the image transfer operation is performed with a constant voltage control of the level obtained with the above current, good images are provided without foggy background due to the memory and without influence of the change in the ambient condition.

In the foregoing embodiments, the constant current control is effected to the transfer roller or the transfer belt (the charging member), the voltage of the charging member is stored. By doing so, even if the resistance of the charging member changes with the change of the ambient conditions, the voltage corresponding to the resistance of the charging member at that time can be held or stored.

It is not inevitable to store the voltage of the charging member. For example, a voltage corresponding to the resistance of the charging member is stored in a part of the output voltage application to the charging member. In response to the stored voltage, the voltage level applied to the transfer roller 2 during the constant voltage operation is determined.

Figure 18:
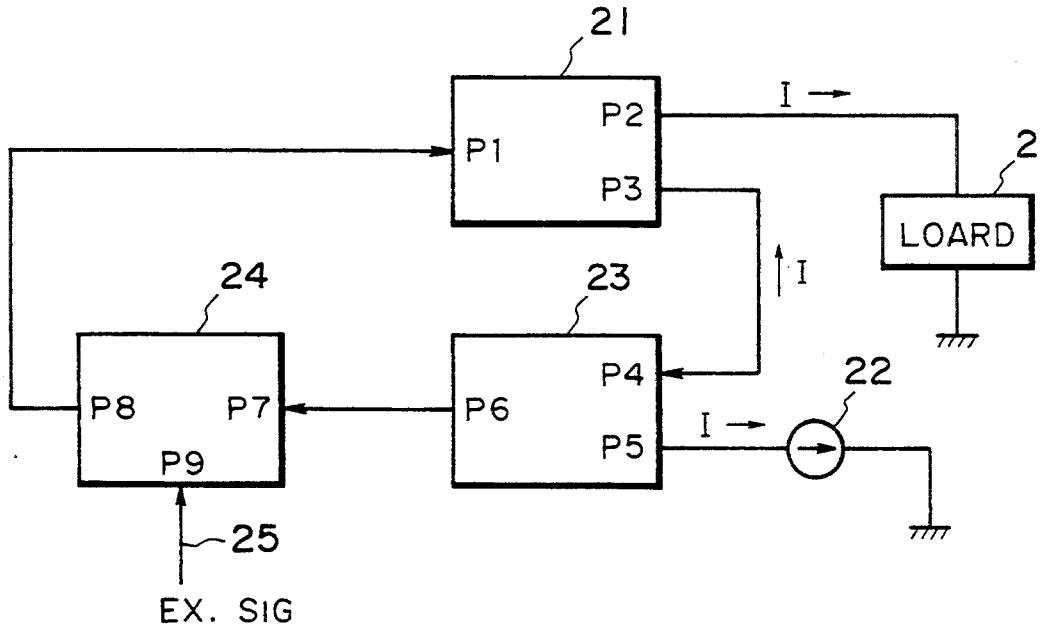
FIG. 18 is a block diagram illustrating the structure of a constant current detecting and voltage storing circuit.

FIG. 18 shows a circuit for the ATVC control to the transfer roller in this manner. FIG. 18 is a block diagram of a constant current detecting and voltage maintaining circuit. It comprises a voltage converting circuit 21 to amplify the voltage applied to a terminal P1 and produce an amplified high voltage output between the terminals P2 and P3. Designated by a reference numeral 2 is a load such as a transfer roller, and produces an electric field having a polarity opposite to the toner electrically deposited on the photosensitive member, by the high voltage provided from the terminal P2. The circuit further comprises a reference current source 22 and a differential current amplifier 23 for amplifying a difference between the current through the terminal P4 and the current through the terminal P5. The amplified current is converted to a voltage and the differential voltage is supplied to the terminal P7 of a sample holding circuit 24. The sample holding circuit 24 receives the differential voltage through the terminal P7 from the terminal P6 of the differential current amplifier circuit 23, and it holds the differential voltage and supplies it through the terminals P8 and P1 to the voltage converting circuit 21. The sample holding circuit 24 holds the voltage level supplied from the terminal P6 and transmits the held voltage, alternately on the basis of on state and off state of an external signal (produced by an unshown controller) supplied to the terminal P9.

Figure 19:
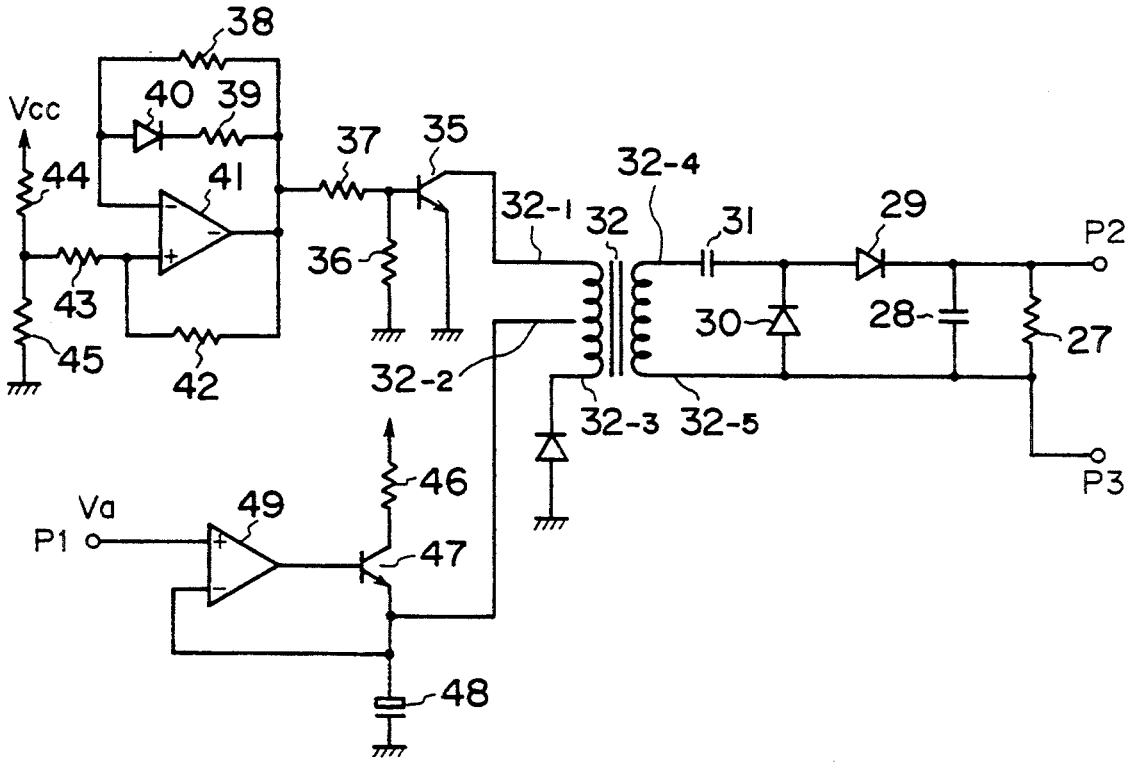
FIG. 19 is a block diagram illustrating the structure of a voltage converting circuit shown in FIG. 18.

FIG. 19 is a block diagram illustrating the structure of the voltage converting circuit 21 shown in FIG. 18, and the same reference numerals as in FIG. 18 are assigned to the elements having the corresponding functions.

The circuit comprises a resistor 46, a transistor 47 having a base connected to an operational amplifier 49 and a emitter connected to a capacitor 48. By the elements 46, 47 and 48, a voltage buffer is constituted, and a voltage equal to a voltage Va applied to the terminal P1 is applied to an intermediate tap 32-2 of a first side of a transformer 32. The circuit further comprises resistors 36–39, 42–45, a transistor 35, a diode 40 and an operational amplifier 41. By the resistors 36–39, 42–45, the transistor 35, the diode 40 and the operational amplifier 41, an oscillation circuit is constituted. A collector of the transistor 35 is connected to a terminal 32-1 of a primary winding of the transformer 32, the cathode side of the diode 33 is connected to the terminal 32-3. The transistor 35 switches the primary winding of the transformer 32 to produce a driving current in the secondary winding. When the ratio of the number of primary windings and the number of the secondary windings is 1:n, the amplitude of the voltage pulse at the terminals 32-1 and the terminal 32-3, is 2Va as shown in FIG. 8, and a voltage pulse of 2nVa is produced between the terminals 32-4 and 32-5.

The circuit further includes a resistor 27, capacitors 28 and 31 and diodes 29 and 30 wherein the capacitor 31 is connected to the terminal of the secondary winding of the transformer 32 and an anode side of the diode 30 is contacted to the terminal 32-5, as shown in the Figure.

By the above elements 27–31, a voltage doubler rectifying circuit is constituted, by which a voltage pulse produced between the terminals 32-4 and the terminal 32-5 of the secondary winding of the transformer 32 is converted to a DC voltage 2nVa. Thus, the voltage applied to the terminal P1 is amplified by 2n and the amplified voltage is produced between the terminal P2 and the terminal P3.

Figure 20:
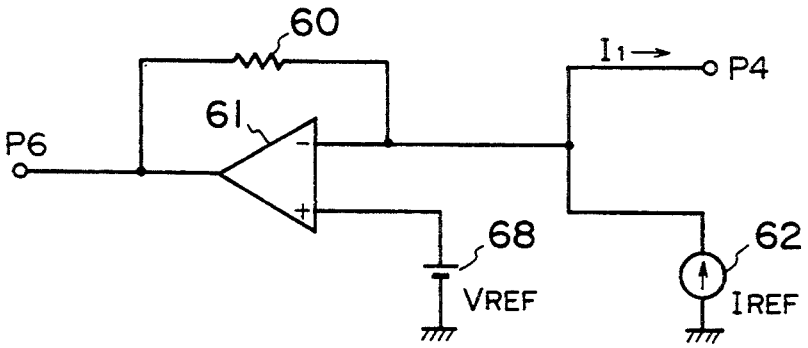
FIG. 20 shows output voltage characteristics of the voltage converting circuit of FIG. 19.

FIG. 20 is a circuit diagram illustrating the structures of the differential current amplifying circuit 23 shown in FIG. 18 and the reference current source 22, wherein the same reference numerals as in FIG. 18 are assigned to the elements having the corresponding functions.

As shown in the Figure, the circuit comprises a resistor 60, and operational amplifier 61 and a reference current source 62 wherein a voltage Vref of the reference voltage source is inputted to the positive phase side input of the operational amplifier 61. The operational amplifier 61 amplifies the differential current and produces a voltage Vc1 which is a differential voltage. A terminal P6 produces a voltage Vc1 which is obtained by the following:

$$Vc1 = Rref + Ra(I_1 - Iref) \quad (1)$$

where Iref is a reference current applied from a reference current source 62 to a reverse phase input, Ra is a resistance of the resistor 60, and $I_1$ is a current flowing through the terminal P4. The directions of the reference current Iref and the current $I_1$ are as shown in the Figure.

Figure 21:
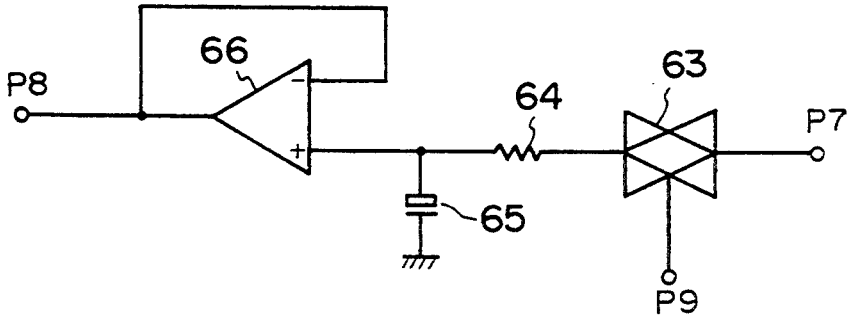
FIG. 21 is a block diagram showing a structure of a sample holding circuit shown in FIG. 18.

FIG. 21 is a block diagram illustrating the structure of the sample holding circuit 24 shown in FIG. 18. The same reference numerals as in FIG. 18 are assigned to the elements having the corresponding functions.

As shown in the Figure, the circuit comprises an analog switch 63 which is for example, micro PC 4066 available from Nippon Electric Company, Japan which is actuated or deactivated by a control signal supplied to the terminal P9, and it controls supply or stop of the differential voltage, that is, the above-described voltage Vc1 to be supplied to the terminal P7.

The circuit comprises a resistor 64, a capacitor 65, an operational amplifier 66. By the resistor 64, the capacitor 35 and the operational amplifier 66, the sample holding circuit 24 is constituted. When the signal at the terminal P9 is at the high level, the analog switch 63 is actuated, by which the sample holding circuit 24 operates as an integrating circuit. If the low level is produced at the terminal P9, the analog switch 63 is opened, by which the voltage applied to the terminal P7 is not transmitted to the terminal P8, so that the voltage stored in the capacitor 63 is outputted.

The operation of the circuit of FIG. 18 will be described in detail. The differential voltage amplifier circuit amplifies the differential current between the current flowing through the load 2 and the reference current provided by the reference current source 22, and supplies its output to the sample holding circuit 24.

When the level of the signal at the terminal P9 of the sample holding circuit 24 becomes high, the output of the differential current amplifier circuit is converted to a high voltage by the voltage converting circuit 21, and the voltage is supplied to the load 2. Therefore, when the level of the signal output terminal P9 is high, a feed back loop is formed.

If the current flowing through the load 2 is larger than the reference current, the input to the voltage converting circuit 21 is small, and as a result, the load current decreases. On the contrary, if the current flowing through the load 2 is smaller than the reference current, the input of the voltage converting circuit 21 becomes large, and as a result, the load current increases. If the gain of the differential current amplifying circuit 23 is sufficiently large (actually, if the resistance Ra of the above equation (1) is sufficiently large), the load current becomes equal to the reference current.

In this manner, when the signal at the terminal P9 is high, the constant current control is effected. When the constant current control is effected with the signal of the terminal P9 at the high level, the signal at the terminal P9 is converted to the low level, by which the output of the differential current amplifying circuit 23 is not transmitted to the voltage converting circuit 21. At this time, the voltage stored in the capacitor 65 shown in FIG. 21 is produced at the terminal P7, and the high voltage corresponding to the voltage is supplied to the load 2. That is, the voltage when the constant current is detected is stored. When the signal level at the terminal P9 is low, a slight amount of leak current flows into the output terminal of the analog switch 63 or the input terminal of the operational amplifier 66. By this, the level of the stored voltage changes with time. In order to reduce the change of the stored voltage due to the leak current, the capacitance of the capacitor 65 may be increased.

In the embodiments in the foregoing, the transfer roller or belt (charging member) is ATVC-controlled, but this is not limiting. For example, as shown in FIG. 1 the ATVC control may be performed to the charging roller 3 when the good charging operation is disturbed by the resistance variation of the charging roller 33 caused by the ambient variations.

The present invention is not limited to the cases of the image side exposure or to the reverse development system. It is applicable to the background exposure wherein the portion of the photosensitive member which does not receive the toner by the development is exposed to light, or to a regular development wherein the latent image is developed with toner electrically charged to the polarity opposite to the charging property of the latent image, with the same advantageous effects.

In the foregoing, the constant current control is performed during the transfer material non-passage period or during the non-image portion passage period. However, when the image exposure and/or image development operation is performed to deposit the toner onto the image bearing member during the non-passage period, such as, the pre-rotation period or the sheet interval period, for the purpose of improving the cleaning of the photosensitive member or improving the development property or the like, it is effective that the ATVC control is performed on the toner image.

As described in the foregoing, according to the image forming apparatus of the present invention, good images can be produced under various ambient conditions.

In addition, according to the image forming apparatus of the present invention, the good transfer properties can be provided at all times for various sizes of the transfer material and under various ambient conditions.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on said image bearing member;

a charging member disposed opposing said image bearing member; and bias applying means for applying a bias voltage to said charging member, wherein said bias applying means effects a constant voltage control to said charging member by supplying a constant voltage level thereto when an image area of said image bearing member is in a charging region of said charging member, and effects a constant current control by supplying a current to said charging member so as to maintain a constant level of current flow from said charging member to said image bearing member, while said image bearing member moves, during at least a part of a period in which an area of said image bearing member other than the image area is in the charging region, and wherein a level of a constant voltage of the constant voltage control is determined during the constant current control.

2. An apparatus according to claim 1, wherein said charging member is contactable to said image bearing member.

3. An apparatus according to claim 1, wherein the image on said image bearing member is transferred onto a transfer material by passing the transfer material between said image bearing member and said charging member so that the transfer material is contacted to a surface of said image bearing member on which the image is formed, in the charging region.

4. An apparatus according to claim 1, wherein said image forming means includes latent image forming means for forming a latent image on said image bearing member and developing means for developing the latent image with toner.

5. An apparatus according to claim 4, wherein the image area of said image bearing member is an area in which a toner image is formed on said image bearing member.

6. An apparatus according to claim 3, wherein the image area of said image bearing member is an area which is contacted to the transfer material.

7. An apparatus according to claim 1, wherein the area other than the image area is on upstream and downstream sides of the image area with respect to a movement direction of said image bearing member.

8. An apparatus according to claim 3, wherein the period includes a period in which the transfer material is not in the charging region.

9. An apparatus according to claim 1, wherein the period includes a period in which said image bearing member is moved before the image is produced.

10. An apparatus according to claim 1, wherein the area other than the image area includes an area between the image region and a next image region during continuous image formation on said image bearing member.

11. An apparatus according to claim 1, wherein the constant current control is effected before the image is produced, and the constant voltage control is effected until a predetermined number of the image areas reach the charging region.

12. An apparatus according to claim 11, wherein when a predetermined number of image areas pass through the charging region, the constant current control is effected, and the operation is repeated.

13. An apparatus according to claim 2, wherein said charging member is in the form of a roller.

14. An apparatus according to claim 2, wherein said charging member is in the form of a belt.

15. An apparatus according to claim 4, wherein said latent image forming means includes charging means for charging said image bearing member.

16. An image forming apparatus according to claim 15, wherein said charging means includes a second charging member and second bias voltage applying means having the same structure as said charging member and bias applying means, respectively.

17. An apparatus according to claim 15, wherein the image on said image bearing member is transferred onto a transfer material by passing the transfer material between said image bearing member and said charging member so that the transfer material is contacted to the surface of said image bearing member on which the image is formed, in the charging region.

18. An apparatus according to claim 17, wherein said image bearing member is a photosensitive member, and said latent image forming means includes exposure means for exposing said image bearing member electrically charged by said charging means to light in accordance with image information.

19. An apparatus according to claim 17, wherein prior to the latent image being formed on said image bearing member, said charging means charges an area of said image bearing member which is to be in the charging region during the constant current control.

20. An apparatus according to claim 17 or 19, wherein said developing means develops the latent image with toner having a polarity which is the same as the charging polarity of said charging means.

21. An apparatus according to claim 20, wherein said image bearing member is a photosensitive member, and said latent image forming means includes exposure means for exposing said image bearing member electrically charged by said charging means to light in accordance with image information.

22. An apparatus according to claim 15, wherein said latent image forming means includes exposure means for exposing said image bearing member electrically charged by said charging means to light in accordance with image information, and wherein said exposure means exposes to light at least a part of an area other than the image area of said image bearing member, and the exposed area is different from the area of said image bearing member in the charging region during the constant current control.

23. An apparatus according to claim 1, wherein said bias applying means stores a voltage produced during the constant current control, and the stored voltage is used during the constant voltage control.

24. An image forming apparatus, comprising:

a movable image bearing member;

image forming means for forming an image on said image bearing member;

transfer means for transferring the image from said image bearing member onto a transfer material in an image transfer region, said transfer means including a charging member opposing said image bearing member and bias applying means for applying a bias voltage to said charging member, wherein said bias applying means effects a constant voltage control to said charging member by supplying a constant voltage level thereto when an image area of said image bearing member is in the transfer region, and effects a constant current control to said charging member by supplying a current to said charging member so as to maintain a constant level of current flow from said charging member to said image bearing member, while said image bearing member moves, during at least a part of a period in which an area of said image bearing member other than the image area is in the transfer region, wherein a level of a voltage of the constant voltage control is determined on the basis of a voltage produced in the transfer means during the constant current control.

25. An apparatus according to claim 24, wherein said charging member is contactable to said image bearing member.

26. An apparatus according to claim 24, wherein said image forming means includes latent image forming means for forming a latent image on said image bearing member and developing means for developing the latent image with toner.

27. An apparatus according to claim 26, wherein the image area of said image bearing member is an area in which a toner image is formed on said image bearing member.

28. An apparatus according to claim 24, wherein the image area of said image bearing member is an area which is contacted to the transfer material.

29. An apparatus according to claim 24, wherein the area other than the image area is on upstream and downstream sides of the image area with respect to a movement direction of said image bearing member.

30. An apparatus according to claim 24, wherein the period includes a period in which the transfer material is not in the transfer region.

31. An apparatus according to claim 24, wherein the period includes a period in which said image bearing member is moved before the image is produced.

32. An apparatus according to claim 24, wherein the area other than the image area includes an area between the image region and a next image region during continuous image formation on said image bearing member.

33. An apparatus according to claim 24, wherein the constant current control is effected before the image is produced, and the constant voltage control is effected until a predetermined number of the image areas reach the transfer region.

34. An apparatus according to claim 33, wherein when a predetermined number of image areas pass through the transfer region, the constant current control is effected, and the operation is repeated.

35. An apparatus according to claim 25, wherein said charging member is in the form of a roller.

36. An apparatus according to claim 25, wherein said charging member is in the form of a belt.

37. An apparatus according to claim 26, wherein said latent image forming means includes charging means for charging said image bearing member.

38. An apparatus according to claim 37, wherein said image bearing member is a photosensitive member, and said latent image forming means includes exposure means for exposing said image bearing member electrically charged by said charging means to light in accordance with image information.

39. An apparatus according to claim 37, wherein prior to the latent image being formed on said image bearing member, said charging means charges an area of said image bearing member which is to be in the transfer region during the constant current control.

40. An apparatus according to claim 37 or 39, wherein said developing means develops the latent image with toner electrically charged to the same polarity as the charging polarity of said charging means.

41. An apparatus according to claim 40, wherein said image bearing member is a photosensitive member, and said latent image forming means includes exposure means for exposing said image bearing member electrically charged by said charging means to light in accordance with image information.

42. An apparatus according to claim 38, wherein said exposure means exposes to light at least a part of an area other than the image area of said image bearing member, and the exposed area is different from the area of the image bearing member in the transfer region during the constant current control.

43. An apparatus according to claim 24, wherein the voltage level of said transfer means is a voltage produced at said charging member.

44. An apparatus according to claim 24, wherein the voltage level produced in said transfer means is a voltage produced in the said applying means.

45. An apparatus according to claim 24, wherein said bias applying means stores the voltage produced in said transfer means, and controls said charging member using the stored voltage, during the constant voltage control.

46. An apparatus according to claim 24, wherein the voltage produced in said transfer means corresponds to a resistance of the charging member.

47. An image forming apparatus comprising:

a movable image bearing member;

image forming means for forming an image on said image bearing member;

a charging member opposed to said image bearing member;

bias applying means for applying a bias voltage to said charging member, wherein said bias applying means effects a constant voltage control to said charging member by supplying a constant voltage level thereto when an image area of said image bearing member is in a charging region of said charging member, and effect a constant current control to said charging member by supplying a current to said charging member so as to maintain a constant level of current flow from said charging member to said image bearing member, while said image bearing member moves, during a part of period in which an area of said image bearing member other than the image area is in the charging region; and storing means for storing a voltage appearing during the constant current control, and determining a level of voltage of the constant voltage control on the basis of the stored voltage.

48. An apparatus according to claim 47, wherein said charging member is contactable to said image bearing member.

49. An apparatus according to claim 47, wherein the image on said image bearing member is transferred onto a transfer material by passing the transfer material between said image bearing member and said charging member so that the transfer material is contacted to the surface of said image bearing member on which the image is formed, in the charging region.

50. An apparatus according to claim 47, wherein said image forming means includes latent image forming means for forming a latent image on said image bearing member and developing means for developing the latent image with toner.

51. An apparatus according to claim 50, wherein the image area of said image bearing member is an area in which a toner image is formed on said image bearing member.

52. An apparatus according to claim 49, wherein the image area of said image bearing member is an area which is contacted to the transfer material.

53. An apparatus according to claim 47, wherein the area other than the image area is on upstream and downstream sides of the image area with respect to a movement direction of said image bearing member.

54. An apparatus according to claim 49, wherein the period includes a period in which the transfer material is not in the charging region.

55. An apparatus according to claim 47, wherein the period includes a period in which said image bearing member is moved before the image is produced.

56. An apparatus according to claim 47, wherein the area other than the image area includes an area between the image region and a next image region during continuous image formation on said image bearing member.

57. An apparatus according to claim 47, wherein the constant current control is effected before the image is produced, and the constant voltage control is effected until a predetermined number of the image areas reach the charging region.

58. An apparatus according to claim 57, wherein when a predetermined number of image areas pass through the charging region, the constant current control is effected, and the operation is repeated.

59. An apparatus according to claim 48, wherein said charging member is in the form of a roller.

60. An apparatus according to claim 48, wherein said charging member is in the form of a belt.

61. An apparatus according to claim 50, wherein said latent image forming means includes charging means for charging said image bearing member.

62. An image forming apparatus according to claim 61, wherein said charging means includes a second charging member and second bias voltage applying means having the same structure as said charging member and bias applying means, respectively.

63. An apparatus according to claim 61, wherein the image on said image bearing member is transferred onto a transfer material by passing the transfer material between said image bearing member and said charging member so that the transfer material is contacted to a surface of said image bearing member on which the image is formed, in the charging region.

64. An apparatus according to claim 63, wherein said image bearing member is a photosensitive member, and said latent image forming means includes exposure means for exposing said image bearing member electrically charged by said charging means to light in accordance with image information.

65. An apparatus according to claim 63, wherein prior to the latent image being formed on said image bearing member, said charging means charges an area of said image bearing member which is to be in the charging region during the constant current control.

66. An apparatus according to claim 63 or 65, wherein said developing means develops the latent image with toner having a polarity which is the same as the charging polarity of the charging means.

67. An apparatus according to claim 66, wherein said image bearing member is a photosensitive member, and said latent image forming means includes exposure means for exposing said image bearing member electrically charged by said charging means to light in accordance with image information.

68. An apparatus according to claim 61, wherein said latent image forming means includes exposure means for exposing said image bearing member electrically charged by said charging means to light in accordance with image information, and wherein said exposure means exposes to light at least a part of an area other than the image area of said image bearing member, and the exposed area is different from the area of the image bearing member in the charging region during the constant current control.

69. An apparatus according to claim 47, wherein said bias applying means controls said charging member using the stored voltage, during the constant voltage control.

70. An image forming apparatus comprising:

a movable image bearing member;

image forming means for forming an image on said image bearing member;

a charging member disposed opposing said image bearing member; and bias applying means for applying a bias voltage to said charging member, wherein said bias applying means effects a constant voltage control to said charging member by supplying a constant voltage level to said charging member when an image area of said image bearing member is in a charging region of said charging member, and effects a constant current control by supplying a current to said charging member so as to maintain a constant level of current flow from said charging member to said image bearing member, while said image bearing member moves, during at least a part of a period in which an area of said image bearing member other than the image area is in the charging region.

71. An apparatus according to claim 21, wherein said exposure means exposes to light at least a part of an area other than the image area of said image bearing member, and the exposed area is different from the area of the image bearing member in the charging region during the constant current control.

72. An apparatus according to claim 41, wherein said exposure means exposes to light at least a part of an area other than the image area of said image bearing member, and the exposed area is different from the area of the image bearing member in the transfer region during the constant current control.

73. An apparatus according to claim 67, wherein said exposure means exposes to light at least a part of an area other than the image area of said image bearing member, and the exposed area is different from the area of the image bearing member in the charging region during the constant current control.

74. An image forming apparatus comprising:

image forming means for forming an image on a recording material, said image forming means including a movable image bearing member, a charging member disposed opposing said image bearing member and a power source for supplying electric power to said charging member;

first control means for supplying a current to said charging member so as to maintain a constant level of current flow from said charging member to said image bearing member, during at least a part of a period in which an area of said image bearing member other than an image area is in a charging region of said charging member, while said image bearing member moves;

storing means for storing a voltage provided during operation of said first control means; and second control means for controlling an image forming condition of said image forming means on the basis of the voltage stored by said storing means.

75. An apparatus according to claim 74, wherein said charging member is an image transfer member for transferring the image from said image bearing member onto the recording material at the charging region.

76. An apparatus according to claim 75, wherein said charging member contacts a back side of the recording material.

77. An apparatus according to claim 75, wherein said image forming means further includes developing means for developing a latent image formed on said image bearing member into a toner image, and wherein said first control means constant-current controls the charging member during at least a part of a period in which the toner image is not in the charging region.

78. An apparatus according to claim 75, wherein said image forming means, further includes developing means for developing a latent image formed on said image bearing member into a toner image, and wherein said first control means constant-current controls the charging member during at least a part of a period in which neither the toner image nor the recording material is in the charging region.

79. An apparatus according to claim 74, further comprising constant voltage control means for supplying said charging member with a constant level of voltage, wherein said second control means controls the voltage level supplied by said constant voltage control means in accordance with the voltage stored in said storing means.

80. An apparatus according to claim 77, further comprising constant voltage control means for supplying said transfer member with a predetermined constant level of voltage, wherein said second control means controls the voltage level supplied by said constant voltage control means during an image transfer operation in accordance with the voltage stored in said storing means.

81. An apparatus according to claim 78, further comprising constant voltage control means for supplying said transfer member with a predetermined constant level of voltage, wherein said second control means controls the voltage level supplied by said constant voltage control means during an image transfer operation in accordance with the voltage stored in said storing means.

82. An apparatus according to claim 74, wherein said charging member is a rotatable member.

83. An apparatus according to any one of claims 74, 76, 77, 78, 79, 80, 81 and 82, wherein said charging member contacts said image bearing member.

84. An image forming apparatus, comprising:

image forming means for forming an image on a recording material, said image forming means including a movable image bearing member, a charging member disposed opposing said image bearing member and a power source for supplying electric power to said charging member;

first control means for supplying a current to said charging member so as to maintain a constant level of current flow from said charging member to said image bearing member, while said image bearing member moves, during at least a part of a period in which the recording material is not in a charging region of said charging member;

storing means for storing a voltage provided during operation of said first control means; and second control means for controlling an image forming condition of said image forming means on the basis of the voltage stored by said storing means.

85. An apparatus according to claim 84, wherein said charging member is an image transfer member for transferring the image from said image bearing member onto the recording material at the charging region.

86. An apparatus according to claim 85, wherein said charging member contacts a back side of the recording material.

87. An apparatus according to claim 85, wherein said image forming means further includes developing means for developing a latent image formed on said image bearing member into a toner image, and wherein said first control means constant-current controls the charging member, during at least a part of the period in which the recording material is not in the charging region.

88. An apparatus according to claim 84, further comprising constant voltage control means for supplying said charging member with a constant level of voltage, wherein said second control means controls the voltage level supplied by said constant voltage control means in accordance with the voltage stored in said storing means.

89. An apparatus according to claim 87, further comprising constant voltage control means for supplying said transfer member with a predetermined constant level of voltage, wherein said second control means controls the voltage level supplied by said constant voltage control means during an image transfer operation in accordance with the voltage stored in said storing means.

90. An apparatus according to claim 84, wherein said charging member is a rotatable member.

91. An apparatus according to any one of claims 84, 86, 87, 88, 89 and 90, wherein said charging member contacts said image bearing member.

92. An apparatus according to any one of claims to 82 and 84 to 90, wherein the voltage stored by said storing means is a voltage applied to said charging means during operation of said first control means.

93. An apparatus according to any one of claims 74 to 82, wherein said image bearing member is a photosensitive member, and said image forming means includes exposure means for exposing said photosensitive member to image light, wherein said exposure means exposes an area other than the image area of the image bearing member, and the area exposed by said exposure means is different from the area of the image bearing member in the charging region during operation of said first control means.

* * * * *

UNITED STATES PATENT AND TRADEMARK OFFICE

CERTIFICATE OF CORRECTION

PATENT NO. : 5,450,180

DATED : September 12, 1995

INVENTOR(S) : Yukihiro OHZEKI, et al.

It is certified that error appears in the above-indentified patent and that said Letters Patent is hereby corrected as shown below:

COLUMN 2:

Line 44, "0.514 4" should read --0.5 - 4--.

COLUMN 14:

Line 18, "1" should read --1,--.

COLUMN 18:

Line 12, "the said" should read --said bias--;
Line 33, "effect" should read --effects--.

COLUMN 21:

Line 16, "means," should read --means--.

COLUMN 22:

Line 46, "claims" should read --claims 74--.

Signed and Sealed this

Thirtieth Day of January, 1996

Bruce Lehman

*Attest:*

BRUCE LEHMAN

*Attesting Officer*

*Commissioner of Patents and Trademarks*